US008290395B2

(12) United States Patent
Uchida

(10) Patent No.: US 8,290,395 B2
(45) Date of Patent: Oct. 16, 2012

(54) ELECTROPHOTOGRAPHIC IMAGE FORMING APPARATUS

(75) Inventor: Wataru Uchida, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 430 days.

(21) Appl. No.: 12/564,285

(22) Filed: Sep. 22, 2009

(65) Prior Publication Data

US 2010/0080622 A1 Apr. 1, 2010

(30) Foreign Application Priority Data

Sep. 29, 2008 (JP) ..... 2008-249959
Aug. 4, 2009 (JP) ..... 2009-181780

(51) Int. Cl.
*G03G 15/00* (2006.01)

(52) U.S. Cl. ..... 399/110; 399/116; 399/117

(58) Field of Classification Search ..... 399/111, 399/116, 117, 113
See application file for complete search history.

(56) References Cited

U.S. PATENT DOCUMENTS

| | | | | |
|---|---|---|---|---|
| 7,020,416 | B2 | 3/2006 | Kato et al. | |
| 7,720,405 | B2 | 5/2010 | Okabe | |
| 2004/0062566 | A1 | 4/2004 | Kato et al. | |
| 2006/0153589 | A1 * | 7/2006 | Sato et al. | 399/110 |
| 2007/0286632 | A1 | 12/2007 | Okabe | |
| 2010/0178076 | A1 | 7/2010 | Okabe | |

FOREIGN PATENT DOCUMENTS

| | | | |
|---|---|---|---|
| JP | 11-296049 | A | 10/1999 |
| JP | 2004-118051 | A | 4/2004 |
| JP | 3592522 | B2 | 11/2004 |
| JP | 2006-64835 | A | 3/2006 |
| JP | 2007-264469 | A | 10/2007 |

OTHER PUBLICATIONS

Notification of Reasons for Rejection mailed Mar. 10, 2010, in counterpart Japanese Application No. 2009-181780.

* cited by examiner

*Primary Examiner* — Walter L Lindsay, Jr.
*Assistant Examiner* — Roy Y Yi
(74) *Attorney, Agent, or Firm* — Fitzpatrick, Cella, Harper & Scinto

(57) ABSTRACT

An image forming apparatus for forming an image on a recording material in a state in which a drum cartridge including a photosensitive drum is detachably mountable to a main assembly of the apparatus and in a state in which a developing cartridge including a developing roller for developing with a developer an electrostatic latent image formed on the photosensitive drum and including a developer accommodating portion for accommodating the developer is detachably mountably to the main assembly, is constituted by a cartridge supporting member movable, in a state of detachably supporting the drum and developing cartridges, between an inside position in which the cartridge supporting member is located inside the main assembly and from which the drum and developing cartridges are movable to an image forming position in which the drum and developing cartridges effect image formation and an outside position in which the cartridge supporting member is located outside the main assembly and in which the drum and developing cartridges are mountable and demountable; and a preventing member, provided to the developing cartridge, for preventing demounting of the drum cartridge from the cartridge supporting member in a state in which the developing cartridge is supported by the cartridge supporting member.

14 Claims, 29 Drawing Sheets

(a) COMPLETELY OPENED (b)

(c)

(a)

(b)

ELECTROPHOTOGRAPHIC IMAGE FORMING APPARATUS

FIELD OF THE INVENTION AND RELATED ART

The present invention relates to an electrophotographic image forming apparatus for effecting recording by developing with a developer a latent image formed on the electrophotographic photosensitive member and then transferring and fixing a developer image on a recording material (medium). The electrophotographic image forming apparatus employs the electrophotographic photosensitive member as an image bearing member to form an electrostatic latent image on the electrophotographic photosensitive member through an electrophotographic image forming process and forms an image on the recording material. For example, the electrophotographic image forming apparatus may include an electrophotographic copying machine, an electrophotographic printer (an LED printer, a laser beam printer, etc.), an electrophotographic facsimile machine, and an electrophotographic word processor. It is also possible to use a monochromatic or full-color image forming apparatus used as an output device such as a multi-function device having functions of the above-described machines or a work station. The recording material is subjected to image formation by the electrophotographic image forming apparatus and may include paper, an CHP sheet, and the like.

In recent years, a color printer is connected to and shared among a plurality of host computers through a network and is used for small-lot commercial printing (POD (print on demand)) in many cases. As a representative printer, the electrophotographic image forming apparatus with a low running cost and easy maintenance is used. In the electrophotographic image forming apparatus, exchange of consumables such as the electrophotographic photosensitive member and the developer is enabled to reduce the running cost. Further, in order to facilitate the maintenance of the image forming apparatus, image forming apparatuses enable a user to exchange the above-described consumables. For example, such an electrophotographic image forming apparatus that the exchange of the consumables such as the photosensitive member or the developer is enabled to realize the reduction in running cost and easy exchange of the above-described consumables by the user has been known (Japanese Patent No. 3592522). In the image forming apparatus, a drum cartridge including a photosensitive drum and a developing cartridge accommodating the developer are mountable to a holder member and the holder member can be pulled out from a main assembly of the image forming apparatus (apparatus main assembly).

In the image forming apparatus (of Japanese Patent No. 3592522), the drum cartridge and the developing cartridge can be exchanged in any order in a state in which the holder member is pulled out from the apparatus main assembly. For this reason, there was a possibility that the user erroneously demounted the drum cartridge from the holder member earlier than the developing cartridge even in the case where only the developing cartridge was required to be exchanged due to consumption of the developer. In such a case, the user is required to mount the erroneously demounted drum cartridge to the holder member again. Thereafter, the user is required to demount and exchange the developing cartridge. Normally, an exchange frequency of the developing cartridge is higher than that of the drum cartridge. Therefore, an electrophotographic image forming apparatus improved in exchange operativity of the cartridge has been desired.

SUMMARY OF THE INVENTION

The present invention has been accomplished in view of the above-described problem when an image forming apparatus is utilized for the POD (print on demand).

A principal object of the present invention is to provide an electrophotographic image forming apparatus which has enabled individual exchange of consumables such as a photosensitive member and a developer and has realized improvement in cartridge exchange operativity.

Another object of the present invention is to provide an electrophotographic image forming apparatus which has realized easy cartridge exchange by a user.

A further object of the present invention is to provide an electrophotographic image forming apparatus capable of suppressing erroneous demounting of a cartridge, which is not required to be exchanged, from a cartridge supporting member by the user.

A further object of the present invention is to provide an electrophotographic image forming apparatus which has realized demounting of a developing cartridge, which is higher in exchange frequency than a drum cartridge, from a cartridge supporting member earlier than the drum cartridge.

A further object of the present invention is to provide an electrophotographic image forming apparatus improved in mounting and demounting operativity of the cartridge with respect to the cartridge supporting member by the user.

According to an aspect of the present invention, there is provided an electrophotographic image forming apparatus for forming an image on a recording material in a state in which a drum cartridge including an electrophotographic photosensitive drum is detachably mountable to a main assembly of the electrophotographic image forming apparatus and in a state in which a developing cartridge including a developing roller for developing with a developer an electrostatic latent image formed on the electrophotographic photosensitive drum and including a developer accommodating portion for accommodating the developer is detachably mountable to the main assembly, the electrophotographic image forming apparatus comprising:

a cartridge supporting member movable, in a state of detachably supporting the drum cartridge and the developing cartridge, between an inside position in which the cartridge supporting member is located inside the main assembly and from which the drum cartridge and the developing cartridge are movable to an image forming position in which the drum cartridge and the developing cartridge effect image formation and an outside position in which the cartridge supporting member is located outside the main assembly and in which the drum cartridge and the developing cartridge are mountable and demountable; and a preventing member, provided to the developing cartridge, for preventing demounting of the drum cartridge from the cartridge supporting member in a state in which the developing cartridge is supported by the cartridge supporting member.

According to the present invention, it is possible to provide an electrophotographic image forming apparatus which has enabled individual exchange of consumables such as a photosensitive member and a developer and has realized improvement in cartridge exchange operativity.

According to the present invention, it is also possible to provide an electrophotographic image forming apparatus which has realized easy cartridge exchange by a user.

According to the present invention, it is also possible to provide an electrophotographic image forming apparatus capable of suppressing erroneous demounting of a cartridge, which is not required to be exchanged, from a cartridge supporting member by the user.

According to the present invention, it is also possible to provide an electrophotographic image forming apparatus which has realized demounting of a developing cartridge, which is higher in exchange frequency than a drum cartridge, from a cartridge supporting member earlier than the drum cartridge.

According to the present invention, it is also possible to provide an electrophotographic image forming apparatus improved in mounting and demounting operativity of the cartridge with respect to the cartridge supporting member by the user.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

[Embodiment 1]

(General Structure of Electrophotographic Image Forming Apparatus)

An electrophotographic image forming apparatus in this embodiment includes a rotatable electrophotographic photosensitive drum, an electrostatic latent image forming means for forming an electrostatic latent image on the drum, a developing means for developing with a developer the electrostatic latent image formed on the drum, and a transfer means for transferring a developer image formed on the drum. By these electrophotographic process means, the image is formed on a recording material (medium).

In the following description, a front side (front surface side) of the electrophotographic image forming apparatus means the side on which an apparatus opening/closing door (an opening/closing member) is provided. A rear side of the image forming apparatus is the side opposite to the front side. A front-rear direction includes a frontward direction toward front as seen from the rear side of the image forming apparatus, and a rearward direction is opposite to the frontward direction. The left and right sides mean the left and right sides as seen from the front side of the image forming apparatus. A left-right direction includes a leftward direction toward left as seen from the front side, and a rightward direction is opposite to the leftward direction. Upward(ly) and downward(ly) mean those with respect to a direction of a gravitational force (a vertical direction). An apparatus main assembly is a portion of an image forming apparatus except a drum cartridge and a developing cartridge.

The drum cartridge includes the rotatable electrophotographic photosensitive drum and at least one process means, except the developing means, acting on the drum and is detachably mountable to the apparatus main assembly. The developing means is used for developing with the developer the electrostatic latent image formed on the drum. The developing cartridge includes a developing roller for supplying to the drum the developer used for developing the electrostatic latent image formed on the drum and includes a developer container accommodating the developer and is detachably mountable to the apparatus main assembly.

Figure 1A:
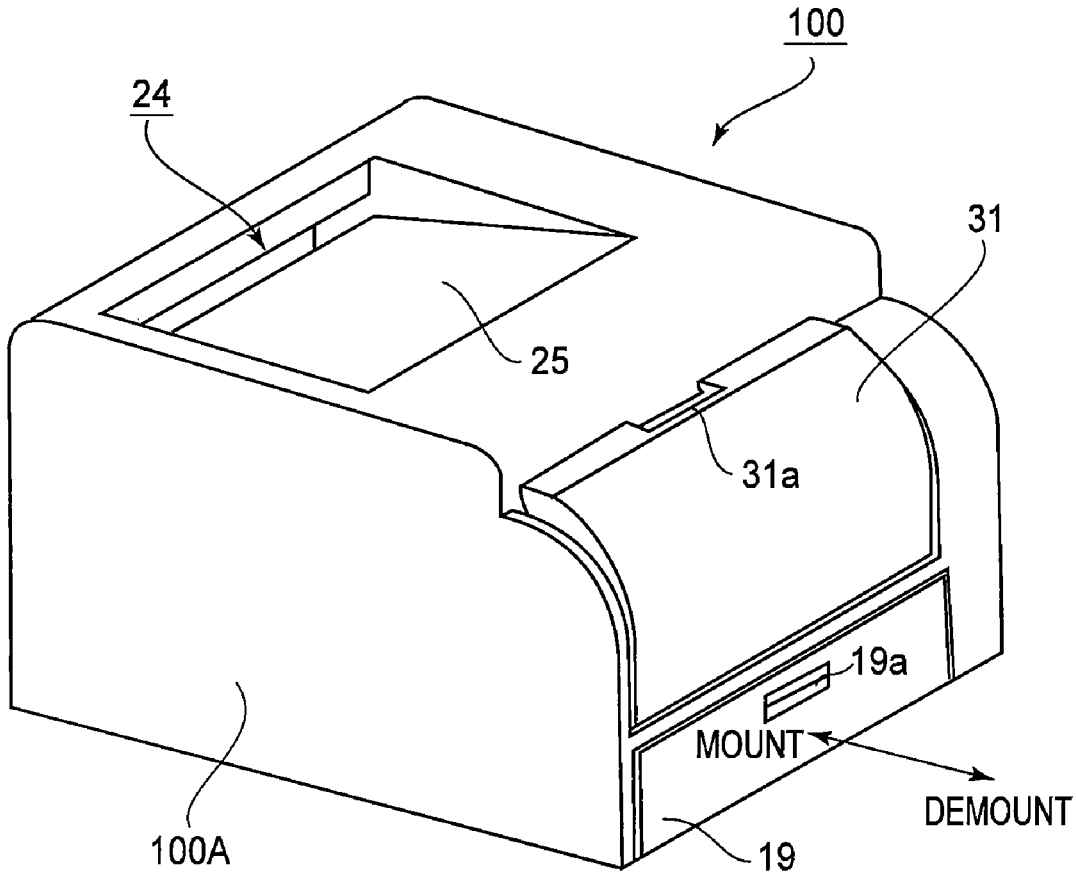
FIG. 1A is a perspective view of an outer appearance of an image forming apparatus in Embodiment 1.
Figure 1B:
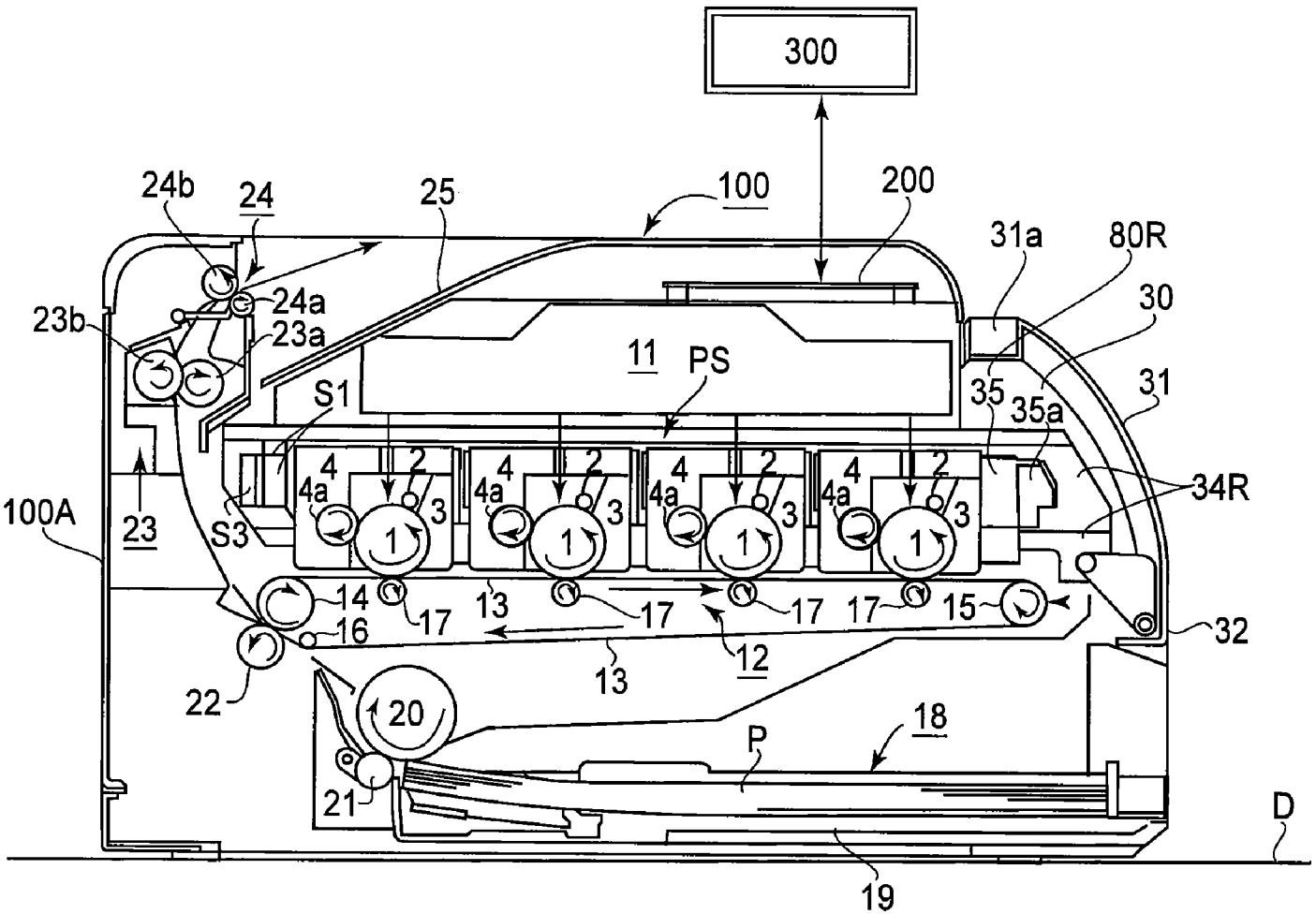
FIG. 1B is a longitudinal left side view of the image forming apparatus.
Figure 2A:
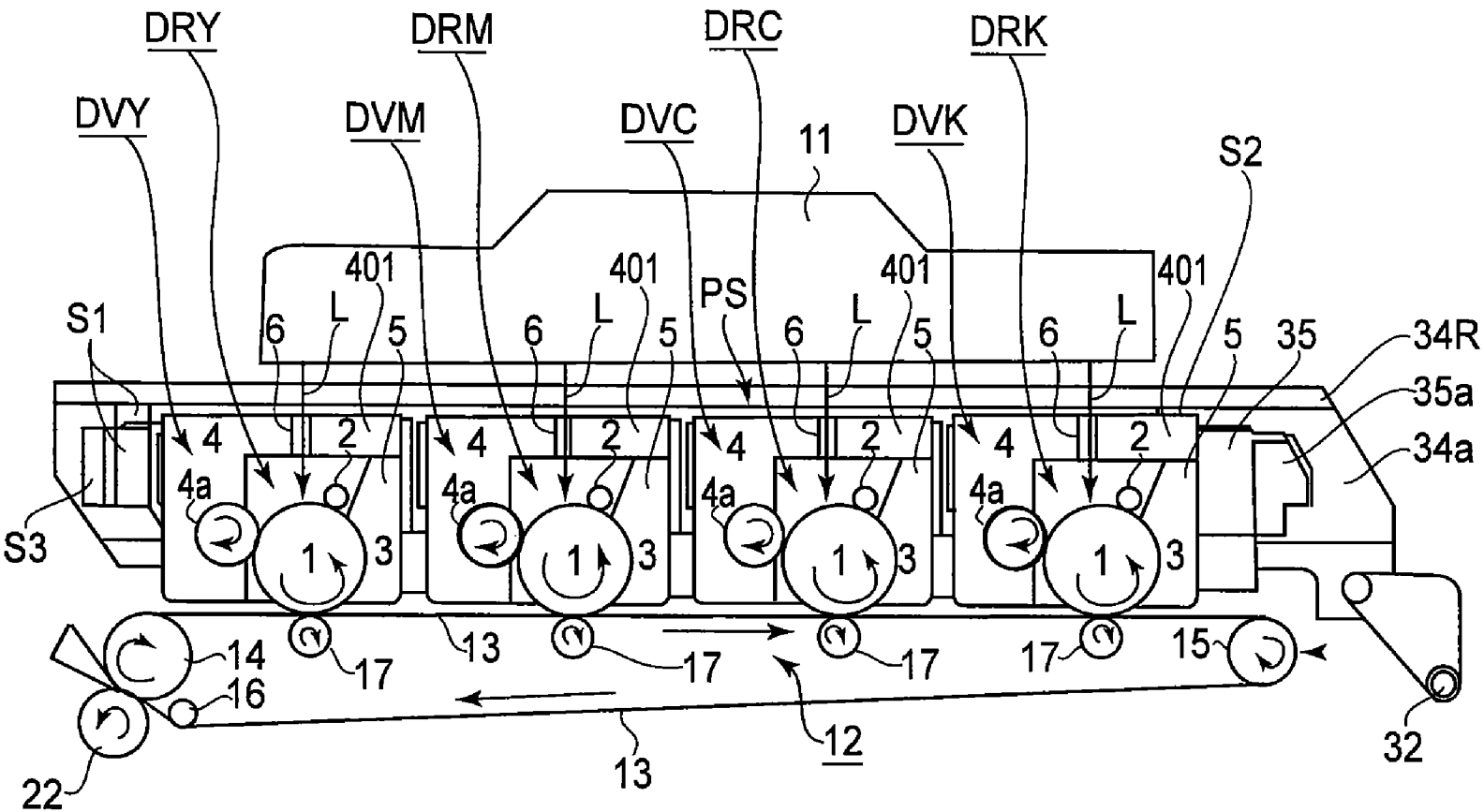
FIG. 2A is a partly enlarged view of FIG. 1B.

FIG. 1A is a perspective view of an outer appearance of an image forming apparatus 100 in this embodiment, FIG. 1B is a longitudinal left side view of the image forming apparatus 100, and FIG. 2A is a partly enlarged view of FIG. 1B. The apparatus 100 is a four color-based full-color laser printer using an electrophotographic process (a color electrophotographic image forming apparatus capable of forming a color image on the recording material). The apparatus 100 effects color image formation on the recording material P on the basis of an electrical image signal input from an external host device 300, such as a personal computer, an image reader, or a remote facsimile machine, to a control circuit portion (control means: CPU (central processing unit) 200. The apparatus 100 is mounted on a substantially horizontal mounting surface of a mounting table, a desk, a floor, or the like. The host device 300 and the circuit portion 200 are connected through LAN (local area network). The circuit portion 200 exchanges various pieces of electrical information with respect to an operating portion (not shown) of the apparatus 100 or the host device 300 and also effects centralized control of an image forming operation of the apparatus 100 in accordance with a predetermined control program or a predetermined reference table. Therefore, the image forming operation described below is controlled by the circuit portion 200.

In the apparatus main assembly 100A, first to fourth drum cartridges DR (DRY, DRM, DRC and DRK) and first to fourth developing cartridges DV (DVY, DVM, DVC and DVK) are horizontally arranged in this order with respect to a rear-to-front direction. That is, the apparatus 100 is an in-line type or tandem type image forming apparatus. A pair of the first drum cartridge DRY and the first developing cartridge DVY constitutes a yellow image forming portion. A pair of the second drum cartridge DRM and the second developing cartridge DVM constitutes a magenta image forming portion. A pair of the third drum carriage DRC and the third developing cartridge DVC constitutes a cyan image forming portion. A pair of the fourth drum cartridge DRK and the fourth developing cartridge DVK constitutes a black image forming portion. The (drum) cartridge DR and the (developing) cartridge DV are located at an image forming position PS in which the image can be formed in the apparatus main assembly 100. The cartridge DR and the cartridge DV located at the position PS are urged by an urging member described later and are held in a state in which the cartridges are positioned and fixed at a positioning portion. Further, as described later, to driving force input portions of the cartridge DR and the cartridge DV, driving force output portions of the apparatus main assembly 100A are connected.

The respective cartridges DR have the same constitution. In this embodiment, each cartridge DR includes a rotatable electrophotographic photosensitive drum 1 as a first image carrying member (hereinafter simply referred to as a "drum"). The cartridge DR also includes a charging device 2 (charging means) and a cleaning device 3 (cleaning means) as process means acting on the drum 1. The drum 1, the charging device 2 and the cleaning device 3 are integrally supported by a drum cartridge frame 5. The charging device is a contact charging roller. The cleaning device 3 is of a blade type.

The respective cartridges DV have the same constitution except that the colors of developers (toners) accommodated therein are different from each other. Each cartridge DV includes a developing roller 4*a* for developing the electrostatic latent image formed on the drum 1 by supplying the drum 1 of an associated cartridge DR and includes a developer container (developer accommodating portion) 4 accommodating the toner.

The container 4 of the first cartridge DVY stores yellow (Y) toner. On the surface of the drum 1 in the first cartridge DVY, a toner (developer) image of yellow (Y) is formed. The container 4 of the second cartridge DVM stores magenta (M) toner. On the surface of the drum 1 in the second cartridge DVM, a toner image of magenta (M) is formed. The container 4 of the third cartridge DVC stores cyan (C) toner. On the surface of the drum 1 in the third cartridge DVC, a toner image of cyan (C) is formed. The developing device 3 of the fourth cartridge DVK stores black (K) toner. On the surface of the drum 1 in the fourth cartridge DVK, a toner image of black (K) is formed.

In the area above the cartridges DR and DV, a laser scanner unit 11 as an image exposure means is disposed. This scanner unit 11 outputs a beam of laser light L modulated correspondingly to image (picture) information for each color input from the host device 300 into the circuit portion 200. Through an exposure window 6 provided at an upper surface of a developing cartridge frame 401, scanning exposure is performed on the surface of the drum 1 of the cartridge DR.

Below the cartridge DR and the cartridge DV, an intermediary transfer belt unit 12 is provided. This belt unit 12 includes an intermediary transfer member as a second image carrying member. In this embodiment, the unit 12 includes, as the intermediary transfer member, an endless belt 13 formed of a dielectric material and having flexibility. The belt unit 12 further includes a driving roller 14, a turn roller 15 and a tension roller 16 around which the belt 13 is stretched and circulatively moved. The driving roller 14 and tension roller 16 are disposed on the rear side of the apparatus main assembly 100A, whereas the turn roller 15 is disposed on the front side of the apparatus main assembly 100A. A lower surface of the drum 1 of each cartridge DR contacts an upper surface of an upper portion of the belt 13. This position of each cartridge DR is the image forming position PS. Inside the belt 13, four primary transfer rollers 17 are disposed so that each transfer roller 17 opposes the drum 1 in the corresponding cartridge through the upper portion of the endless belt 3. The driving roller 14 is disposed opposite to a secondary transfer roller 22 through the belt 13.

Below the belt unit 12, a sheet feeding unit 18 is disposed, which includes a sheet feeding toner 19, a sheet feeding roller 20, a separation roller 21, and the like. The sheet feeding toner 19 is detachably mountable to the apparatus 100 from the front side (front loading). As shown in FIG. 1A, the toner 19 is provided with a grip 19*a* at it front surface.

At an upper portion on the rear side of the apparatus main assembly 100A, a fixing device 23 and a sheet discharging roller pair 24 are disposed. Further, an upper surface of the apparatus main assembly 100A is used as a sheet discharging toner 25. The fixing device 23 includes a fixation film assembly 23*a* and a pressing roller 23*b*. The sheet discharging roller pair 24 includes a sheet discharging rollers 24*a* and 24*b*.

The operation carried out by this image forming apparatus to form a full-color image is as follows. The drum 1 of each cartridges DR is rotationally driven at a predetermined control speed with a predetermined control timing in a counter-clockwise direction indicated by an arrow. Further, the belt 13 is rotationally driven in a clockwise direction indicated by an arrow (in the same (normal) rotational direction of the drum 1 at their contact portion) at a speed which corresponds to the speed of the drum 1. The scanner unit 11 is also driven. In synchronization with the driving of the scanner unit 11, the charging roller 2 in each cartridge DR uniformly electrically charges the surface of the drum 1 to predetermined polarity and potential with a predetermined control timing. The scanner unit 11 scans (exposes) the surface of the drum 1 of each cartridge DR with the beam of laser light L modulated correspondingly to the picture (image) signals for respective colors with a predetermined timing. As a result, an electrostatic latent image corresponding to the picture signals for corresponding color is formed on the surface of the drum 1 of each cartridge DR with a predetermined control timing. The thus formed electrostatic latent image is developed by the associated developing device 3 into a toner image.

Through the above described electrophotographic image forming process, the yellow toner image, which corresponds to the yellow color component of a full-color image is formed on the drum 1 of the first cartridge DRY. This yellow toner image is electrostatically primary-transferred onto the belt 13 by applying to the associated roller 17 a primary transfer bias of an opposite polarity to the charge polarity of the toner with a predetermined control timing.

On the drum 1 of the second cartridge DRM, a magenta developer image, which corresponds to the magenta component of the full-color image is formed, and this toner image is electrostatically primary-transferred onto the belt 13 so that it is superposed on the yellow toner image which has already been transferred on the belt 13, by applying the primary transfer bias to the associated roller 17.

On the drum 1 of the third cartridge DRC, a cyan developer image, which corresponds to the cyan component of the full-color image is formed, and this toner image is electrostatically primary-transferred onto the belt 13 so that it is superposed on the yellow and magenta toner images which have already been transferred the belt 13 by applying the primary transfer bias to the associated roller 17.

On the drum 1 of the fourth cartridge DRK, a black developer image, which corresponds to the black component of the full-color image is formed, and this toner image is electrostatically primary-transferred onto the belt 13 so that it is superposed on the yellow, magenta, and cyan toner images which have already been transferred on the belt 13 by applying the primary transfer bias to the associated roller 17.

Consequently, an unfixed full-color toner image is synthetically formed on the belt 13 by the yellow, magenta, cyan and black toner images.

After the primary transfer of the toner image onto the belt 13, the transfer residual toner remaining on the surface of the drum 1 in each cartridge DR is removed by the cleaning device 4.

Meanwhile, the sheet feeding roller 20 is driven with a predetermined control timing. As a result, sheets (recording material) P stacked on the sheet feeding cassette 19 are separated and fed one by one by cooperation of the sheet feeding roller 20 and the separation roller 21. Then, the recording material P is introduced into a nip (secondary transfer nip) between the secondary transfer roller 22 and belt 13. During nip-conveyance of the recording material P in the nip, a secondary transfer bias of an opposite polarity to the toner charge polarity is applied to the roller 22. As a result, superposed four color toner images are simultaneously transferred onto the recording material P electrostatically.

The recording material P is separated from the surface of the belt 13 and introduced into the fixing device 23, and is subjected to heat and pressure in a fixation nip of the fixing device 23. As a result, color mixing of the respective color toner images and fixation thereof on the recording material P are performed. Thereafter, the recording material P is moved out of the fixing device 23, and then, is discharged as a full-color image formation product onto the tray 25 by the discharge roller pair 24.

After the separation of the recording material P, residual toner remaining on the surface of the belt 13 is, e.g., deposited electrostatically on the surface of the drum 1 at the primary transfer portion of the first cartridge DRY in the case of this embodiment and then is removed by the cleaning device 3.

(Cartridge Exchange Method)

As each cartridge DV is used for image formation, the toner stored in the associated container 4 is consumed. For this reason, e.g., the image forming apparatus is provided with a means (not shown) for detecting an amount of the developer remaining in each cartridge DV. The detected amount of the developer in each cartridge DV is compared, by the control circuit portion 200, with a threshold value preset for issuing a prewarning or warning of its lifetime. When the detected amount of the residual developer is smaller than the threshold value, the prewarning or warning of its lifetime is displayed on a display portion (not shown). As a result, the image forming apparatus prompts the user to prepare an exchange cartridge, or to exchange the cartridge, in order to maintain an output image quality.

In this embodiment, the exchange of the cartridge DV and the cartridge DR is performed through a method in which the cartridges DV and DR are placed on a pull-out type tray 35 and is exchanged in a front-access manner in order to improve usability.

Figure 3A:
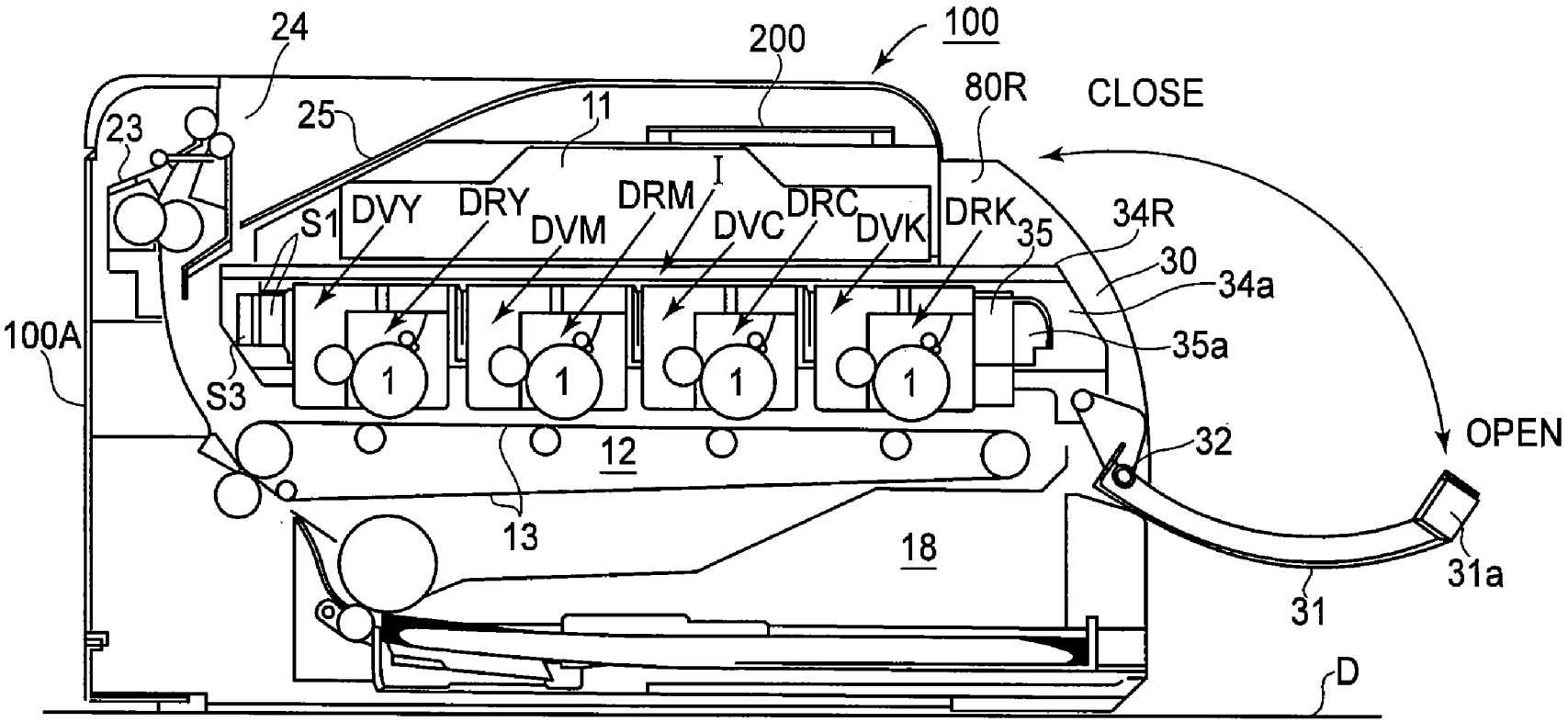
FIG. 3A is a longitudinal left side view of the image forming apparatus in the state in which the front door is opened.

That is, the apparatus 100 is provided with an opening 30 on its front side. The opening 30 permits passing of the cartridge DV and the cartridge DR therethrough in order to demount the cartridge CV and the cartridge DR from the apparatus main assembly 100A. Further, a door 31 movable between a closing position in which the opening 30 is covered and an opening position in which the opening 30 is exposed is provided. In this embodiment, the door 31 can be rotationally moved for opening and closing about a horizontal shaft (hinge shaft) 32, on a lower side of the door 31, with respect to the apparatus main assembly 100A. As a result, the door 31 can be rotationally moved about the hinge shaft 32 in a standing (closing) direction to be placed in a closed state with respect to the apparatus main assembly 100A as shown in FIGS. 1A and 1B. By this closing operation of the door 31, the opening 30 is covered. Further, the door 31 can be inclined and rotationally moved frontward about the hinge shaft 32 to be placed in an opened state with respect to the apparatus main assembly 100A as shown in FIG. 2A and FIG. 3A. By this opening operation of the door 31, the opening 30 is exposed sufficiently. The door 31 is provided with a holding portion 31*a* for opening and closing.

Inside left and right frames 80L and 80R of the main frame of the apparatus main assembly 100A, a pair of left and right tray holding members (movable members or rail members) 34L and 34R are oppositely disposed, respectively and extend in a front-rear direction as a longitudinal (lengthwise) direction thereof. Between the holding members 34L and 34R, a cartridge tray (cartridge supporting member or movable member) 35 which is a frame member is held horizontally slidably in the front-rear direction. Each cartridge DR and each cartridge DV are demountably supported by the tray 35.

Figure 2B:
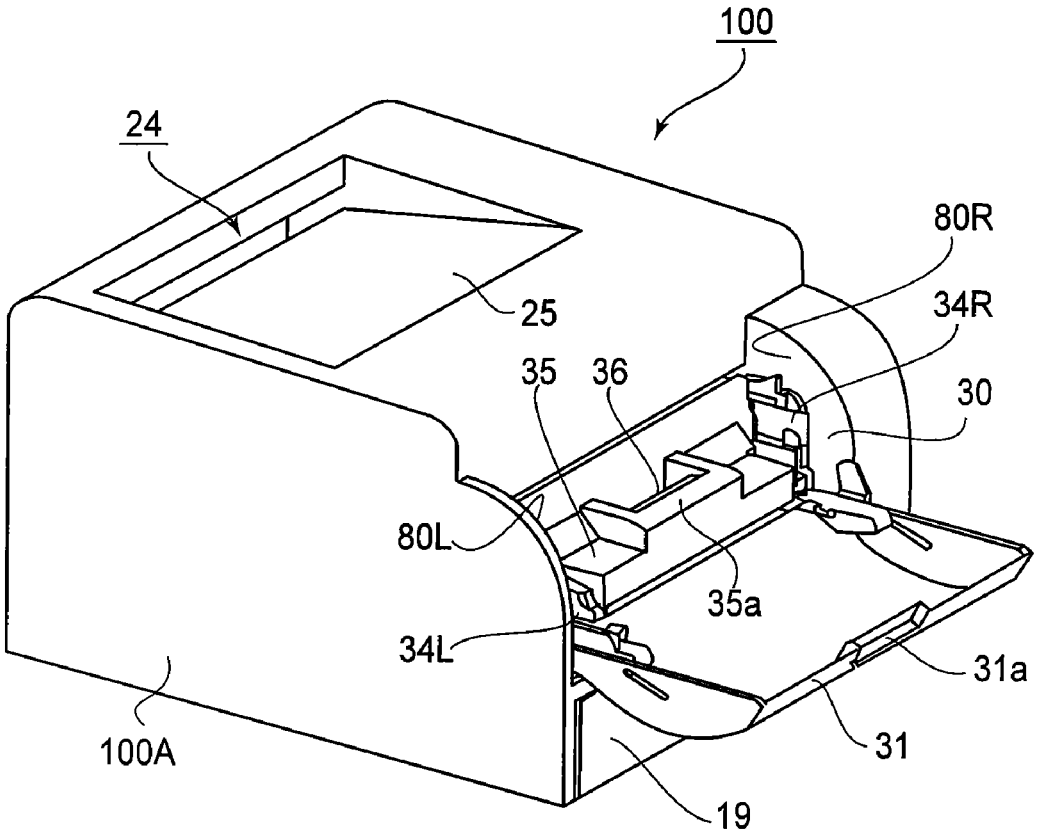
FIG. 2B is a perspective view of the outer appearance of the image forming apparatus in a state in which a front door is opened.
Figure 3B:
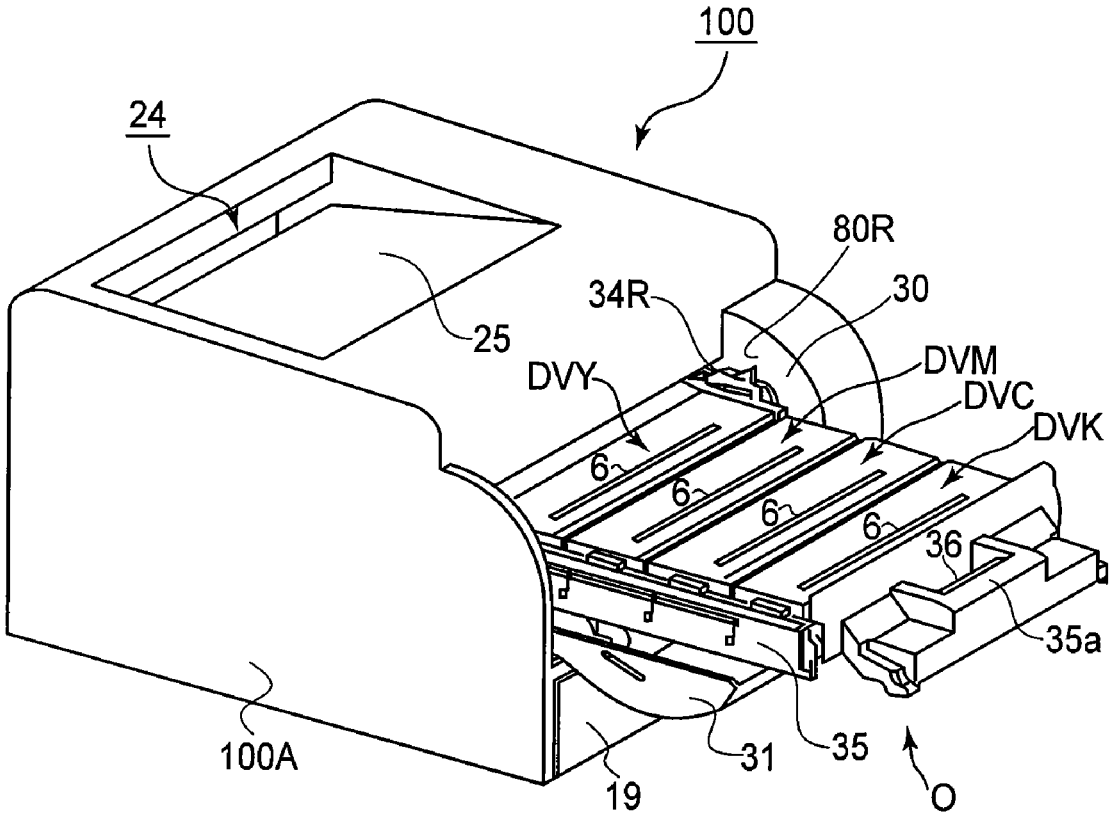
FIG. 3B is a perspective view of the outer appearance of the image forming apparatus in a state in which a tray is pulled out.

By an interrelating mechanism, described later, operated in interrelation with the rotational movement for the opening of the door 31, the holding members 34L and 34R are moved frontward and upward from the position shown in FIG. 1B and FIG. 2A by a predetermined distance. As a result, front portions of the holding members 34L and 34R are pulled out to a position in which the front portions are projected toward the outside of the apparatus main assembly 100A by a predetermined distance as shown in FIGS. 2B and 3B.

Figure 4A:
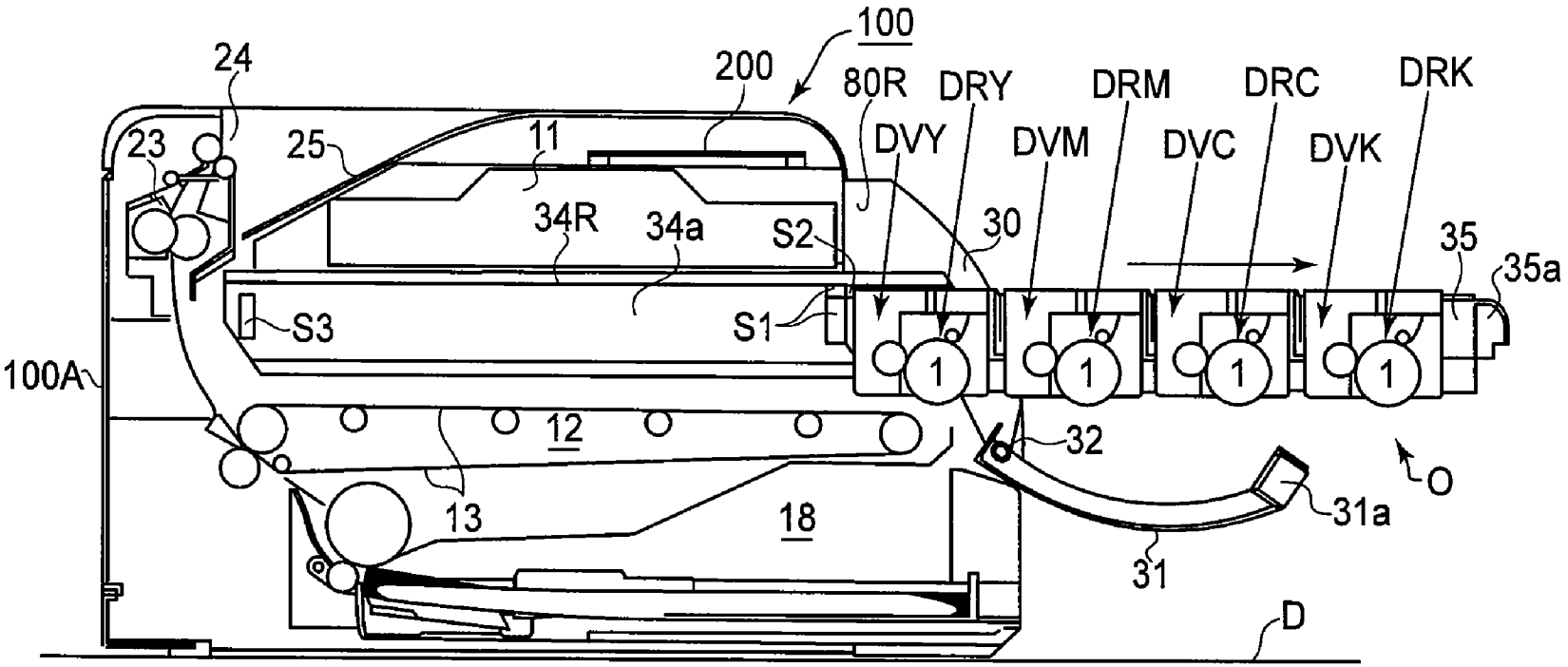
FIG. 4A is a longitudinal left side view of the image forming apparatus in the state in which the tray is pulled out.
Figure 4B:
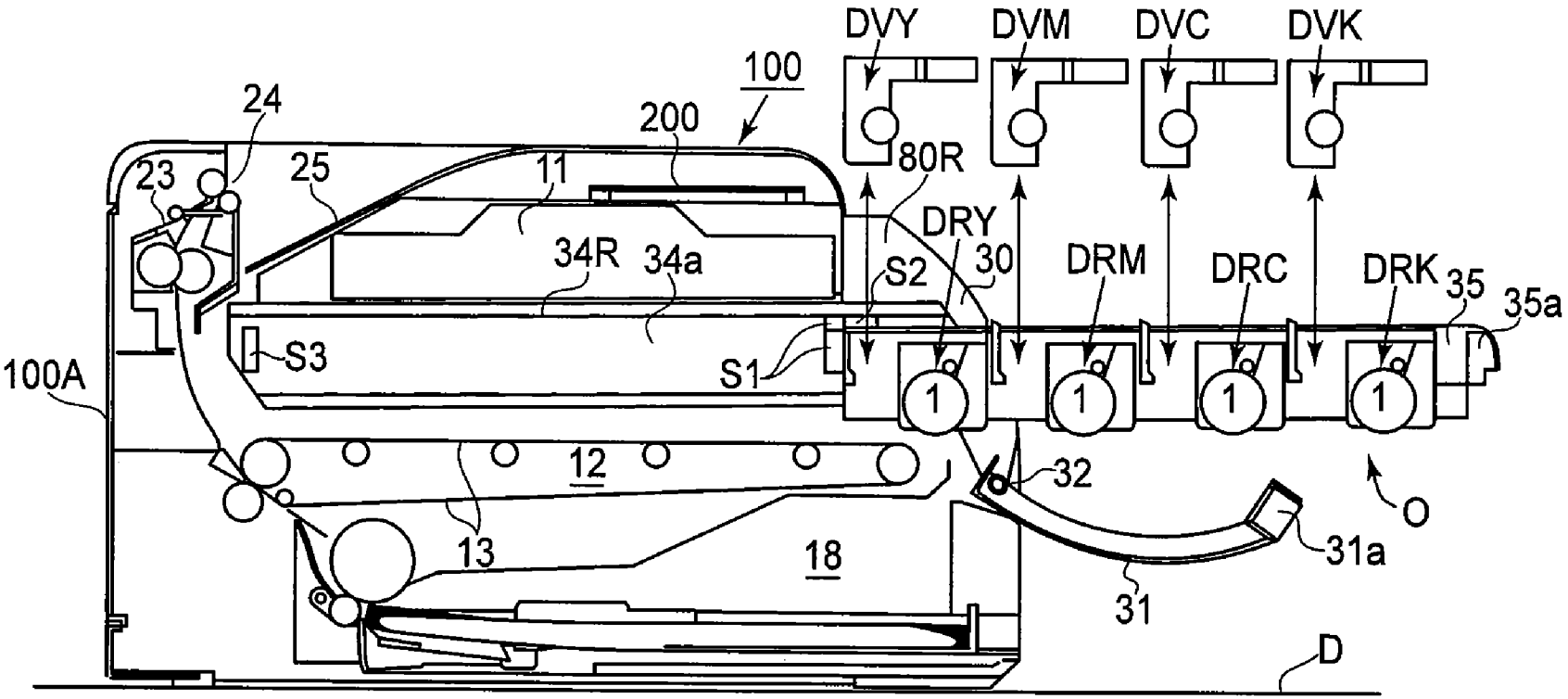
FIG. 4B is a longitudinal left side view of the image forming apparatus in a state in which developing cartridges are demounted from the tray.
Figure 4C:
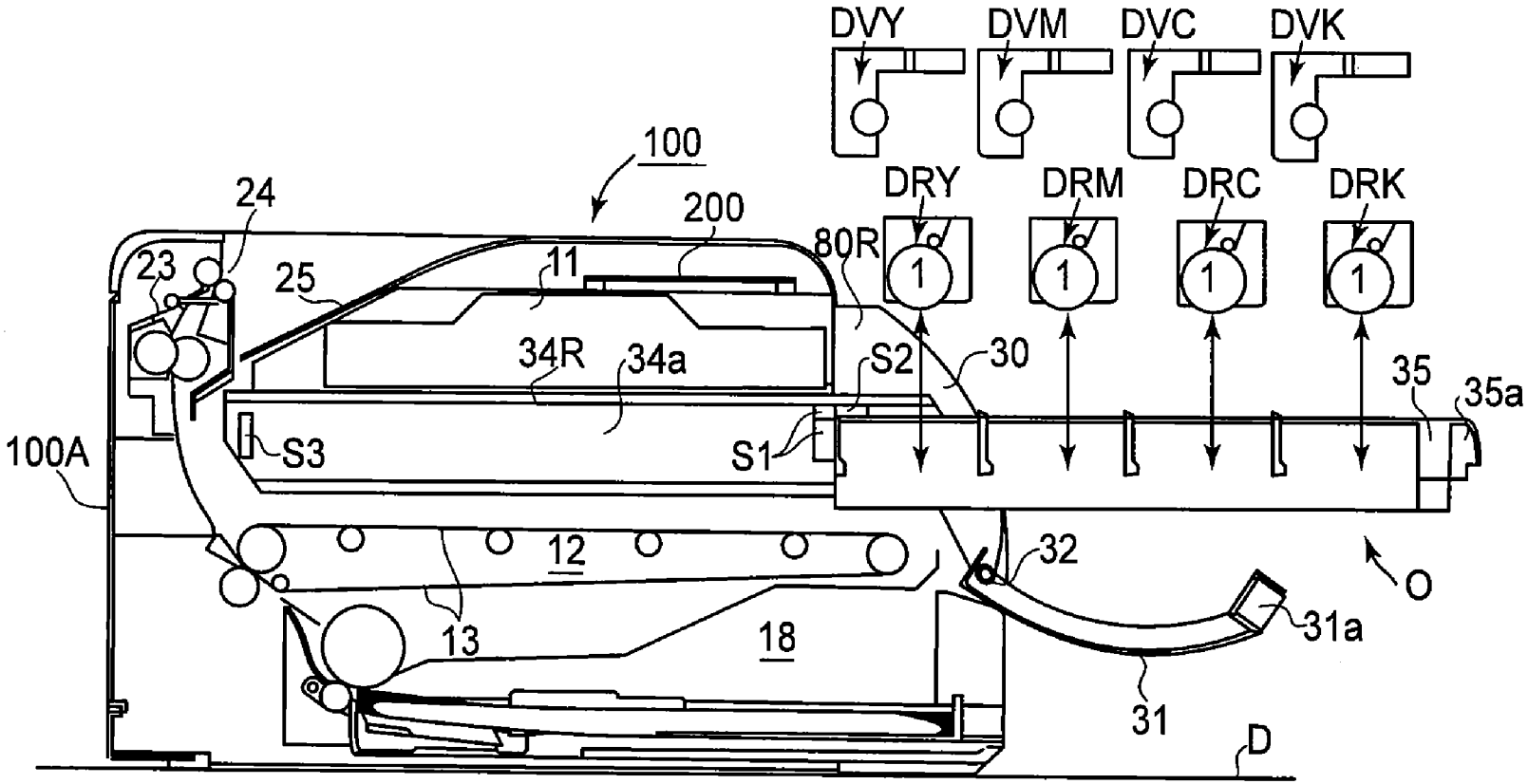
FIG. 4C is a longitudinal left side view of the image forming apparatus in a state in which drum cartridges are demounted from the tray in addition to the developing cartridges.

Further, in interrelation with the movement of the holding members 34L and 34R, drive output portions on the apparatus main assembly side are disengaged from corresponding drive input portions of each of the cartridges DR and DV (driven portion disengagement). Further, urging against each cartridge by an urging member to position and fix the cartridge is removed (urging release). Further, by the above-described movement of the holding members 34L and 34R, the lower surface of the drum 1 of each cartridge DR is separated from the belt 13. The grip 35*a* which is exposed through the opening 30 and is provided to a front frame portion of the tray 35 is gripped together with a tray movement prevention releasing lever 36. Then, the tray 35 is sufficiently pulled out from an inside position I in which the tray 35 is located inside the apparatus main assembly 100A as shown in FIG. 3A to an outside position O in which the tray 35 passed through the opening 30 is located outside the apparatus main assembly 100A until the tray 35 is prevented from being pulled out and moved by stoppers S1 and S2 as shown in FIG. 3B and FIG. 4A. As a result, the entire cartridges DR and DV supported by the tray 35 pass through the opening 30 and are exposed outside the apparatus main assembly 100A, so that upper surfaces of all the cartridges are exposed. At this time, the lower surface of the drum 1 of each cartridge DR is separated from the belt 13, so that friction between the lower surface of the drum 1 and the belt 13 does not occur. The stopper S1 is provided on the tray 35 side. The stopper S2 is provided on the holding member 34L (34R) side. When the tray 35 is sufficiently pulled out, the stopper S1 contacts the stopper S2 as shown in FIGS. 4A to 4C, thus being prevented from being further pulled out and moved. Further, the tray 35 is kept in a state, in which the tray 35 is horizontally pulled out to the outside position O, by the holding members 34L and 34R.

In the state in which the tray 35 is pulled out to the outside position O, the tray 35 supports each cartridge DV so as to be upwardly demountable from the tray 35 as shown in FIG. 4B. Further, the tray 35 supports each cartridge DV by moving each cartridge DV downwardly from above. In the state in which the tray 35 is pulled out to the predetermined outside position O, the tray 35 supports each cartridge DR so as to be upwardly demountable from the tray 35 as shown in FIG. 4C. Further, the tray 35 supports each cartridge DR by moving each cartridge DR downwardly from above.

A used (spent) cartridge DV to be exchanged is demounted from the tray 35 by raising the cartridge DV. In a state in which the cartridge DV is demounted from tray 35, a cartridge DR to be exchanged is demounted from the tray 35 by raising the cartridge DR. In this case, with respect to each set (pair) of the cartridge DR and the cartridge DV, a part of the cartridge DV covers an upper (top) surface of the cartridge DR. For this reason, when the cartridge DV is not demounted, the cartridge DR cannot be demounted. This will be described specifically later.

When a fresh cartridge is engaged in and mounted on in the tray 35 from above, a procedure thereof is the reverse of the demounting. That is, first, the cartridge DR is mounted on the tray 35 and then the cartridge DV is mounted on the tray 35.

When the cartridge to be exchanged is exchanged in the state in which the tray 35 is pulled out to the outside position O as described above, the tray 35 placed in the outside position O is pushed into the inside position I in the apparatus main assembly 100A (FIG. 2B and FIG. 3A). When the tray 35 is sufficiently pushed in, the stopper S1 contacts a stopper S3 provided on the holding member 34L (34R) side, so that the tray 35 is prevented from being further pushed in and moved. Then, the door 31 is closed (FIGS. 1A and 1B). By the operation of the interrelating mechanism, described later, interrelated with the closing movement of the door 31, the cartridge DR and the cartridge DV are located at the image forming portion PS in which the image can be formed in the apparatus main assembly 100A. Then, the cartridges are urged by the urging member to be kept in a state in which the cartridges are positioned and fixed at the position portion of the apparatus main assembly 100A. Further, to the drive input portions of the cartridge DR and the cartridge DV, the drive output portions of the apparatus main assembly 100A are connected. In this embodiment, the tray 35 supports the cartridges DVK, DVC, DVM and DVY accommodating the developers of black (K), cyan (C), magenta (M) and yellow (Y), respectively, arranged from an upstream side to a downstream side with respect to the movement direction of the tray 35 from the outside to the inside of the apparatus main assembly 100A.

According to this embodiment, the cartridge DVK in which an amount of consumption of the developer is larger, i.e., an exchange frequency is higher than those of other cartridges is supported by the tray 35 at the front side of the tray 35. Therefore, when the cartridge DVK is exchanged, the cartridge DVK can be exposed outside the apparatus main assembly 100A only by being slightly pulled out outwardly from the apparatus main assembly 100A. That is, when the cartridge DVK is exchanged, it is not necessary to pull out the tray 35 to the position in which the pulling out of the tray 35 is prevented by the stoppers S1 and S2. Therefore, exchange operativity of the cartridge DVK was improved. That is, when the cartridge DVK located on the most downstream side with respect to the pulling-out direction of the tray 35 is mounted and demounted, the tray 35 is not required to be located at the outside position O. Even in such a case, the tray 35 is outwardly pulled out compared with the case where the cartridge DR and the cartridge DV are located at the image forming position PS. Therefore, compared with the case where the cartridge DVK is located at the image forming portion PS, the cartridge DVK is pulled out outwardly, so that the user can easily exchange the cartridge DVK.

In the above, the tray 35 functions as the cartridge supporting member which is movable between the above-described inside position I and outside position O in the direction perpendicular to the longitudinal direction of the cartridge DR and the cartridge DV supported side by side on the tray 35. The tray 35 also functions as the cartridge supporting member demountably (detachably) supporting the cartridge DR and the cartridge DV. Further, the tray 35 functions as the cartridge supporting member which passes through the opening 30 to move between the inside position I and the outside position O. In the inside position I, the cartridge DR and the cartridge DV are movable to the image forming position PS. The outside position O is a mounting and demounting position in which the cartridge DR and the cartridge DV are mountable to and demountable from the tray 35.

The holding members 34L and 34R function as a moving means for moving the tray 35 from the image forming position PS to the inside position I before the tray is moved to the outside position O in which the cartridge DR and the cartridge DV are mountable to and demountable from the tray 35 and also functions as a moving means for moving the tray 35 from the inside position I to the image forming position PS. In other words, the holding members 34L and 34R functions as a tray supporting member for supporting the tray 35. Further, the holding members 34L and 34R are movable between a first position for permitting movement of the tray 35 between the inside position I and the outside position O and a second position for permitting movement of the tray 35 to the image forming position. By the interrelating mechanism, described later, operated in interrelation with the closing operation of the door 31, the holding members 34L and 34R are moved from the first position to the second position. Further, in interrelation with the opening operation of the door 31, the holding members 34L and 34R are moved from the second position to the first position. As described above, the tray 35 moves between the inside position I in which the tray 35 is located inside the apparatus main assembly 100A while supporting the cartridge DR and the cartridge DV and the outside position O in which the tray is located outside the apparatus main assembly 100A. The outside position O is a cartridge mounting and demounting position in which the cartridge DR and the cartridge DV are mountable to and demountable from the tray 35 by the user. In the outside position O, the cartridge DR and the cartridge DV supported by (mounting to) the tray 35 are moved to the inside position I when the user pushes the tray 35 into the apparatus main assembly 100A. Then, the cartridge DR and the cartridge DV are moved and located at the image forming position contributing to the image formation. In this embodiment, at the image forming position PS, a part of the drum 1 contacts the belt 13. When the door 31 is closed in the state in which the tray 35 is located at the inside position I, the tray 35 is lowered and thus the cartridge DR and the cartridge DV are located at the image forming position PS. Then, when the door 31 is opened, with the raised tray 35, the cartridge DR and the cartridge DV are also raised. As a result, the drum 1 is separated from the belt 13. In this state, the user pulls the tray 35 toward the outside position O located outside the apparatus main assembly 100A. In the cartridge mounting and demounting position, the cartridge DR and the cartridge DV are subjected to mounting and demounting with respect to the tray 35. The cartridge mounting and demounting position is located downstream of the image forming position with respect to the tray pulling-out direction. Further, in the cartridge mounting and demounting position, the user can demount the cartridge DR and the cartridge DV, which are supported by the tray 35, from the tray 35 from the outside of the apparatus main assembly 100A and can cause the cartridge DR and the cartridge DV to be supported by the tray 35 from the outside of the apparatus main assembly 100A. The mounting and demounting position is not limited to the position located outside the apparatus main assembly 100A but may also be a position in which the cartridge DR and the cartridge DV can be mounted to and demounted from the tray 35 even when the position is located inside the apparatus main assembly 100A.

(Interrelating Mechanism Between Door 31 and Holding Members 34L and 34R and Tray Movement Preventing Means)

Figure 5:
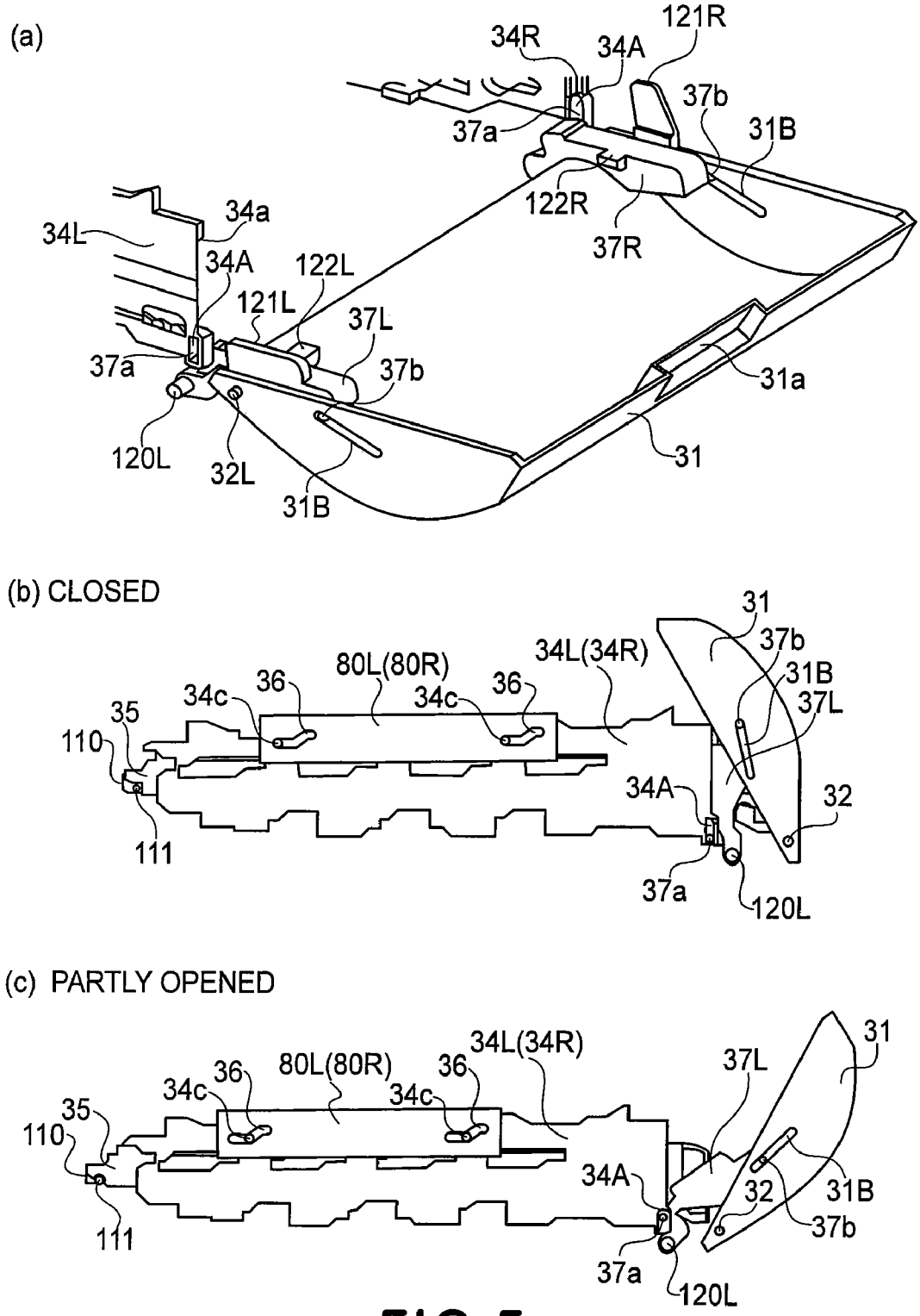
FIG. 5(*a*) is a perspective view showing an interrelating mechanism for interrelating the door with a tray holding member, and FIGS. 5(*b*) and 5(*c*) are schematic views for illustrating an interrelation state between opening/closing of the door and the tray holding member.

The interrelating mechanism between the door 31 and the holding members 34L and 34R and the tray movement preventing means will be described. FIG. 5(*a*) is a perspective view of an interrelating mechanism portion between the door 31 and the holding members 34L and 34R.

The hinge portions 32 (32L and 32R (not shown)) of the door 31 are horizontally disposed with respect to the left-right direction of the apparatus main assembly 100A. These hinge portions 32 are rotatably supported at left and right end portions thereof between shaft-supporting members (not shown) provided on left and right sides of the apparatus main assembly 100A, respectively. These shaft-supporting members may also be left and right frames 80L and 80R (FIG. 2B).

Further, at portions close to left and right end portions of the door 31, connecting arms 37 (37L and 37R) are disposed. Hinge portions 120L and 120R (not shown) provided to the connecting arms 37 are horizontally disposed with respect to the left-right direction of the apparatus main assembly 100A. These hinge portions are rotatably supported by shaft-supporting members (not shown) provided left and right portions of the apparatus main assembly 100A, respectively. These shaft-supporting members may also be the left and right frames 80L and 80R. Each of the arms 37L and 37R is provided with horizontal shafts 37*a* and 37*b*. The horizontal shaft 37*a* of the left connecting arm 37L is engaged in a vertically elongated hole 34A provided to the bottom front portion of the left holding member 34L. Further, the horizontal shaft 37*b* of the left connecting arm 37L is engaged in a groove 31B provided to the left side surface portion of the door 31. The horizontal shaft 37*a* of the right connecting arm 37R is engaged in a vertically elongated hole 34A provided to the bottom front portion of the right holding member 34R. Further, the horizontal shaft 37*b* of the right connecting arm 37R is engaged in a groove 31B provided to the right side surface portion of the door 31. Thus, the door 31 and the holding members 34L and 34R are connected to each other via the connecting arms 37L and 37R, the shafts 37*a* and 37*b*, the holes 34A, and the grooves 31B is opened and closed, a moving force in the front-rear direction acts on the left and right holding members 34L and 34R.

The hinge portions 120L and 120R of the connecting arms 37L and 37R may be disposed coaxially with the hinge portions 32L and 32R of the door 31. Further, without providing the connecting arm 37L and 37R, the door 31 and the holding members 34L and 34R may also be directly connected to each other.

Figure 6:
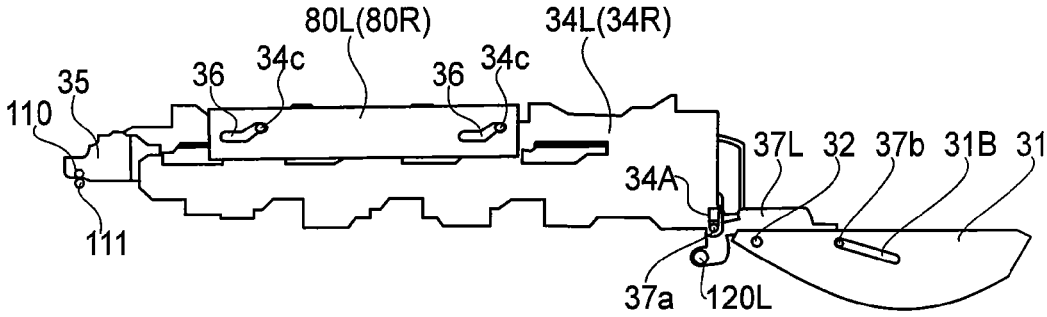
FIG. 6(*a*) is a schematic view for illustrating the interrelating state between the opening/closing of the door and the tray holding member, FIG. 6(*b*) is an enlarged view of a guide hole portion for guiding movement of the tray holding member and FIG. 6(*c*) is an enlarged view of a pin and U-shaped groove as a tray movement preventing means.
Figure 6:
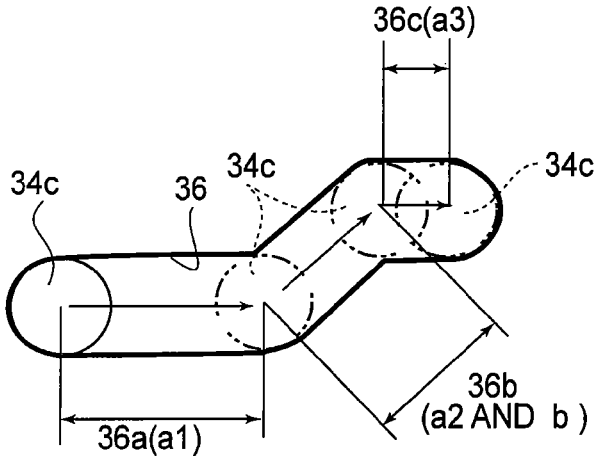
Figure 6:
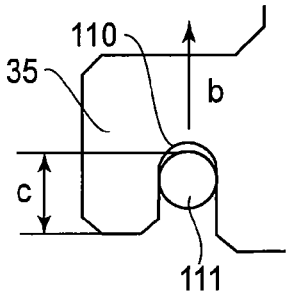

Description will be continued with reference to FIGS. 5(*b*) and 5(*c*) and FIGS. 6(*a*) to 6(*c*). Each of the holding members 34L and 34R is provided with two pins 34*c* which are disposed with a spacing with respect to the front-rear direction. These pins 34*c* are engaged in guide holes 36 provided to left and right frames 80L and 80R of the apparatus main assembly 100A. By the engagement of each pin 34*c* in a corresponding guide hole 36, the holding members 34L and 34R are supported by the frames 80L and 80R, respectively.

Each of FIGS. 5(*b*), 5(*c*) and 6(*a*) shows the two pins 34*c* of the left holding member 34L, and the guide holes 36 of the left frame 80L. Although those for the right holding member 34R and the right frame 8DR are not shown, similarly as in the case of the left side, the pins 34*c* and the corresponding guide holes 36 of the right frame 80L are symmetrically positioned relative to those on the left side.

Therefore, the left and right holding members 34L and 34R have such a latitude that the members are movable relative to the left and right frames 80, within a guide range set by the guide holes 36.

FIG. 6(*b*) is an enlarged view of one of the guide holes 36. Each guide hole 36 includes first, second, and third guiding sections 36*a*, 36*b*, and 36*c*. The first guiding section 36*a* is a horizontal section parallel to the front-rear direction. The second guiding section 36*b* extends frontward from the front end of the first section 36*a*, slanting upward. The third guiding section 36*c* extends horizontally frontward from the front end (top portion) of the second guiding section 36*b* and can stop and stably hold the pin 34*c*.

The pins 34*c*, i.e., the holding members 34L and 34R are moved by a distance a1, in interrelation with the opening rotational movement of the door 31, in the horizontal direction along the first guiding section 36*a*, and then, is moved slantingly upward (in the horizontal direction by a distance a2 and in a vertical direction by a distance b) along the second guiding section 36*b*. Then, finally, they are moved in the horizontal direction by a distance a3 along the third guiding section 36*c*.

FIG. 5(*b*) shows a state in which the door 31 is sufficiently closed against the opening 30 of the apparatus main assembly 100A. In this state, the holding members 34L and 34R have been moved rearward in the apparatus main assembly 100A via the hinge shaft 32, the connecting arms 37L and 37R, the horizontal shafts 37*a*, and the vertically elongated holes 34*b*. Further, each pin 34*c* is located at the rear end of the first guiding section 36*a* of the guide hole 36. Therefore, the holding members 34L and 34R are held in a predetermined lower position (the above-described second position). The tray 35 which is held by the holding members 34L and 34R is held in a predetermined lower position (the above-described image forming position).

Each cartridge DR held in the tray 35 is urged by the urging member described later at its left and right upper surface portions. As a result, as described later, with respect to each cartridge DR the lower surface portions (portions to be positioned) of the shaft supporting portions on the drive side and on the non-drive side are fixed at the positioning portions provided to the stay members (inner side plates) of the apparatus main assembly 100A. That is, each cartridge DR is positioned relative to the apparatus main assembly 100A in a predetermined manner. In this state, the lower surface of the drum 1 in each cartridge DR stably contacts the upper surface of the upper portion of the belt 13 (the unit 12). Each cartridge DV is also held in the positioned state by the positioning means.

The drive input portions (coupling engaging portions) of each cartridge DR and each cartridge DV are placed in a state in which the drive output portions (drum drive coupling and development drive coupling) of the apparatus main assembly 100A are engaged therein, respectively.

On the right side of the tray 35, a downward U-shaped groove 110 is provided. This U-shaped groove 110 engages with a pin 111 as a stationary member fixed to the right frame 80R of the apparatus main assembly 100A to be positioned (tray movement prevention).

FIG. 5(*c*) shows a state in which the door 31 is partly opened. As the door 31 placed in the closed state as shown in FIG. 5(*b*) is opened, holding members 34L and 34R are pulled frontward in the apparatus main assembly 100A in interrelation with the opening of the door 31. As a result, the holding members 34L and 34R are moved frontward by the distance a1, since the pins 34*c* are guided by the first guiding section 36*a* (FIG. 6(*b*)) of the guide hole 36. FIG. 5(*c*) shows this state. During the moving process of the holding members 34L and 34R by the distance a1, the coupling between the drive output portions of the apparatus main assembly 100A and the drive input portions of each cartridge DR are released. Further, the coupling between the drive output portions of the apparatus main assembly 100A and the drive input portions of each cartridge DV are released. Further, the urging positioning of each cartridge DR by the urging member is released. At this time, the pin 111 provided to the right frame 80 enters the U-shaped hole 110 to be positioned so that the tray 35 is prevented from following the above-described movement of the holding members 34L and 34R. That is, the tray 35 is prevented from moving with respect to the apparatus main assembly 100A.

Then, in interrelation with the further opening rotational movement of the door 31, the holding members 34L and 34R are pulled frontward further in the apparatus main assembly 100A. As a result, the holding members 34L and 34R move in the slanting upward direction, with the pins 34*c* being guided by the second guiding section 36*b* of the guiding hole 36.

Referring to FIG. 6(*c*), a distance by which the pin 111 enters U-shaped groove 110 is taken as c. Further, a distance by which the U-shaped groove 110 is vertically displaced by the movement of the holding members 34L and 34R, which hold the tray 35, in the slantingly upward direction is taken as b. During this slantingly upward movement of the holding member 34, as long as the U-shaped groove 110 is engaged with the pin 111 (c>b), the U-shaped groove 110 of the tray 35 follows only the movement of the holding members 34 in the vertical direction. Then, in a state in which the holding members 34L and 34R are displaced upward to a certain degree (c≦b), the pin 111 comes out of the U-shaped groove 110. By employing such a constitution, in a state in which the lower surface of the drum 1 of each cartridge DR held in the tray 35 is in contact with the belt 13, the tray 35 does not horizontally move. Therefore, it is possible to prevent occurrences of damage and memory caused by friction between the drum 1 and the belt 13.

FIG. 6(*a*) shows a state in which the door 31 is sufficiently opened. In this state, the holding members 34L and 34R have finished their slantingly upward movement effected by the second guiding section 36*b*, so that the pins 34*c* are located in the horizontal third guiding section 36*c*. That is, the holding members 34L and 34R are horizontally moved after the slantingly upward movement. This is because cartridges and holding members 34L and 34R can be kept stably at a position with respect to the vertical direction and the holding members 34L and 34R can be prevented from shifting rearward when exchanging the cartridge(s) by pulling out the tray 35 from the holding members 34L and 34R.

In the state shown in FIG. 6(*a*), the pin 111 has already come out of the U-shaped groove 110, so that the positioning state of the tray 35 is released (tray movement prevention release).

Therefore, the tray 35 is slidably movable horizontally in the front-rear direction with respect to the holding members 34L and 34R.

The operation in the case where the door 31 placed in the opened state is closed is the reverse of the above-described operation.

The above-described groove 110 and the pin 111 are a movement preventing means for preventing the tray, at the second position in the apparatus main assembly 100A, from moving in a direction perpendicular to a direction in which the drum 1 of each cartridge DR and the belt 13 contact each other. This prevention of the movement of the tray 35 by the movement preventing means 110 and 111 is released after the tray 35 follows the movement of the belt 13 and the drum 1 held by the holding member 34L and 34R in the contact direction in which the drum 1 contacts the belt 13.

The holding members 34L and 34R are guided along the section 36*a* to move in the direction perpendicular to the direction in which the drum 1 of each cartridge DR and the belt 13 contact each other (first movement). Then, the holding members 34L and 34R are guided along the section 36*b* to move in the standing upward direction including two directional components consisting of the direction in which the drum 1 and the belt 13 contact each other and the direction intersecting with the contact direction (second movement). Thereafter, the holding members 34L and 34R move in the direction intersecting with the direction in which the drum 1 and the belt 13 contact each other.

The holding members 34L and 34R disconnects the driving means for each cartridge DR during the first movement and the tray 35 follows the movement of the holding members 34L and 34R in the directional component in which the drum 1 and the belt 13 contacts each other, and thereafter the above-described movement preventing means 110 and 111. The operation in the case where the door 31 placed in the opened state is closed is the reverse of the above-described operation.

(Drum Cartridge DR and Developing Cartridge DV)

Figure 7:
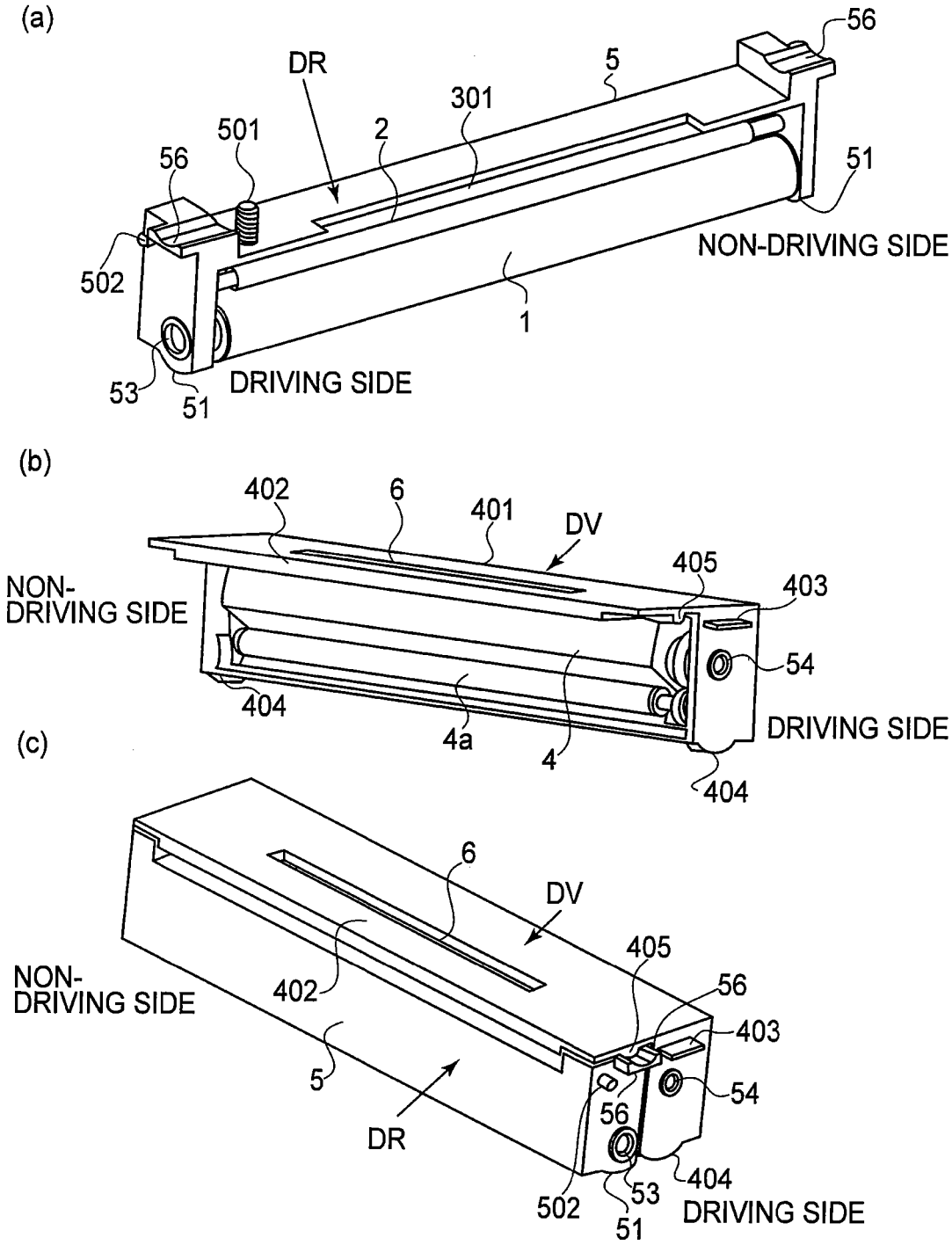
FIG. 7(*a*) is a perspective view of an outer appearance of the drum cartridge, FIG. 7(*b*) is a perspective view of an outer appearance of the developing cartridge, and FIG. 7(*c*) is a perspective view of an outer appearance of the drum cartridge and the developing cartridge disposed in combination.

FIG. 7(*a*) is a perspective view of each cartridge DR as seen from the non-driving side.

Each cartridge DR is an elongated box-type assembly extending in the axial direction of the drum 1 as the left-right direction (longitudinal direction). The drum 1 is rotatably supported, in the cartridge frame 5, between shaft supporting portions provided at side surface portions on the driving side and on the non-driving side. To the shaft supporting portion on the driving side, a coupling engaging portion 53 as the drum drive (driving force) input portion is provided.

The charging roller 2 is supported and disposed rotatably between shaft supporting portions provided at side surface portions on the driving side and on the non-driving side. A cleaning blade 301 is provided at a lower surface of the upper portion of the frame 5 so as to be fixedly supported. A coil spring 501 is fixedly supported and provided at an upper surface of the frame 5. At left and right side surface portions, eaves 56 extended from a top plate portion of the frame 5 in the left-right direction are provided.

FIG. 7(*b*) is a perspective view of each cartridge DV as seen from the driving side.

Each cartridge DV is an elongated box-type assembly extending in the axial direction of the developing roller 4*a* parallel to the axial direction of the drum 1 as the left-right direction (longitudinal direction). The developing roller 4*a* is rotatably supported, in the developing cartridge frame 401, between shaft supporting portions provided at side surface portions on the driving side and on the non-driving side. To the shaft supporting portion on the driving side, a coupling engaging portion 54 as the developing device drive (driving force) input portion for driving the roller 4*a* is provided.

A part of the frame 401 constitutes the container 4 for accommodating the developer. An eave 402 (preventing member) is provided by being extended frontward from a top plate portion of the frame 401. At the side surface portions on the driving side and on the non-driving side eaves 403 (not shown on the non-driving side) extending in the left-right direction are provided.

FIG. 7(*c*) is a perspective view showing a state in which a pair of the cartridge DR and the cartridge DV is mounted to an unshown tray 35. The upper portion of the cartridge DR is covered with the eave 402 of the cartridge DV. For that reason, in the state in which the tray 35 is pulled out, for the cartridge exchange, to the outside position O located outside the apparatus main assembly 100A, the cartridge DR cannot be demounted from the tray 35 without demounting the cartridge DV from the tray 35 in advance. That is, the eave 402 provided to the cartridge DV is the preventing member for preventing the cartridge DR from being demounted from the tray 35. In this embodiment, the cartridge DR and the cartridge DV are to be demounted upwardly from the tray 35. The eave 402 as the preventing member is provided to the cartridge DV so as to extend over the cartridge DR in the state in which the cartridge DR and the cartridge DV are supplied by the tray 35. The eave 402 contacts the cartridge DR when the cartridge DR is intended to be demounted upwardly from the tray 35 in the state in which the cartridge DV is supplied by the tray 35. As a result, the demounting of the cartridge DR is prevented.

As described above, such a constitution that the cartridge DR and the cartridge DV are separately exchangeable and the cartridge DR cannot be demounted until the cartridge DV with a higher exchange frequency is demounted in advance is employed. As a result, an erroneous exchange of the cartridge DR, which did not reach the end of its lifetime, by the user was prevented.

(Tray 35)

Figure 8:
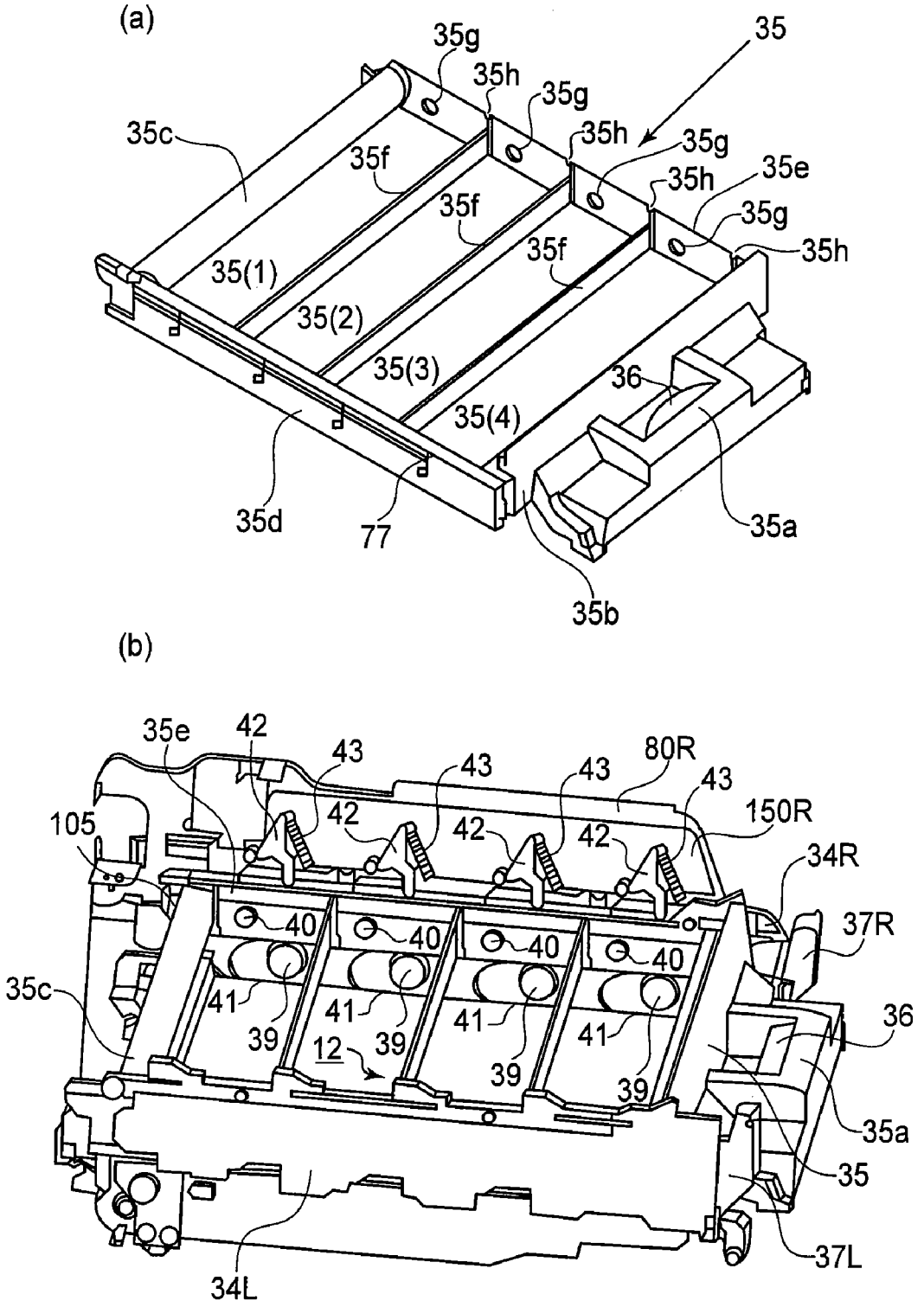
FIG. 8(*a*) is a perspective view of an outer appearance of the tray, and FIG. 8(*b*) is a perspective view for illustrating an interface portion, to be located in the neighborhood of the cartridges, to be released in interrelation with movement of the tray holding member.

FIG. 8(*a*) is a perspective view of an outer appearance of the tray 35.

The tray 35 includes a rectangular frame work portion inside of which is substantially equally partitioned into four areas by three partitioning plates 35*f* with respect to the front-rear direction of the framework portion, so that first to fourth small frame portions 35(1) to 35(4) from the rear frame (plate) 35*c* side to the front frame (plate) 35*b* side are formed in this order. Each of the small frame plates 35(1) to 35(4) is an elongated frame plate extending in the left-right direction. The small frame plates 35(1), 35(2), 35(3) and 35(4) are supporting portions for holding first to fourth sets (pairs) of cartridges DRY and DVY, DRM and DVM, DRC and DVC, and DRK and DVK, respectively. With respect to each of the small frame portions 35(1) to 35(4), a right frame (plate) 35*e* is provided with a hole 35*g* though which a developing device driving coupling (not shown) passes and provided with a U-shaped groove 35*h* into which rotation preventing boss 502 (FIGS. 7(*a*) and 7(*c*)) provided to the cartridge DR is to be inserted.

Each of the first to fourth cartridge sets DRY and DVY, DRM and DVM, DRC and DVC, and DRK and DVK is inserted from above into an associated one of the first to fourth small frame portions 35(1) to 35(4) of the tray 35. Then, lower surfaces of the left and right eaves 56 of each cartridge DR and lower surfaces of the left and right eaves 403 (not shown on the left side) of each cartridge DV are stopped by the upper surfaces of the left and right frames 35*d* and 35*e*. As a result, each cartridge DR and each cartridge DV are accommodated in and supported by the tray 35. That is, the tray 35 supports each cartridge DV demountably above and supports each cartridge DR and each cartridge DV by moving downwardly each cartridge DR and each cartridge DV from above. The tray 35 roughly supports each of the cartridges DR and DV. As a result, it is possible to easily perform exchange of each of the cartridges DR and DV.

The left and right frames 35*d* and 35*e* of the tray 35 are engaged with guide grooves (FIGS. 4A and 4C) which are provided inside the left and right holding members 34L and 34R, respectively, and which are extend in the front-rear direction. As a result, the tray 35 is horizontally slidably movable in the front-rear direction with respect to the holding members 34L and 34R while being supported between the holding members 34L and 34R.

That is, the tray 35 includes the supporting portions 35(1) and 35(4) arranged side by side. The tray 35 is movable in a direction intersecting with the longitudinal direction of the drum 1 of each cartridge DR in a state in which each cartridge DR and each cartridge DV are disposed side by side and supported by the associated support portion. In this embodiment, the four cartridge sets consisting of DRY and DVY for forming the yellow (Y) toner image, DRM and DVM for forming the magenta (M) toner image, DRC and DVC for forming the cyan (C) toner image, and DRK and DVK for forming the black (K) toner image are arranged side by side and supported by the tray 35. The tray moves between the inside position I located inside the apparatus main assembly 100A and the outside position O located outside the apparatus main assembly 100A. The inside position I is a position from which each cartridge DR and each cartridge DV are movable to the image forming position in which each cartridge DR and each cartridge DV are subjected to the image formation. The outside position O is a position in which each cartridge DR and each cartridge DV are mountable to and demountable from the tray 35. As shown in FIGS. 3B and 4A, the tray 35 is pulled out to the outside position O. A cartridge to be exchanged held in the tray 35 is exchanged (FIG. 4B and 4C).

Then, the tray 35 is oppositely moved to and pushed in the inside position I, in the apparatus main assembly 100A, so that the tray 35 is returned to the side before the pulling out as shown in FIGS. 2B and 3A. At this time, the lower surface of the drum 1 of each cartridge DR is separated from the belt 13, so that friction between the lower surface of the drum 1 and the belt 13 is not caused. Then, the opened door 31 is closed as shown in FIGS. 1A and 1B. In interrelation with the closing rotational movement of the door 31, the holding members 34L and 34R are moved rearward and downwardly by a predetermined distance. As a result, each cartridge is located at the image forming position. In interrelation with the movement of the holding members 34L and 34R, each cartridge DR and each cartridge DV is urged by the urging member (not shown) to be fixed and held at the positioning portion on the apparatus main assembly 100A side. Each cartridge DR is urged by each cartridge DV via the coil spring 501 (FIG. 7(*a*)) to be fixed and held at the positioning portion on the apparatus main assembly 100A side, so that the lower surface of the drum 1 of each cartridge DR contacts the belt 13 at a predetermined position. Further, to the drive input portions of each cartridge DR and each cartridge DV, the drive output portions of the apparatus main assembly 100A are connected.

(Interface Portions)

Figure 9A:
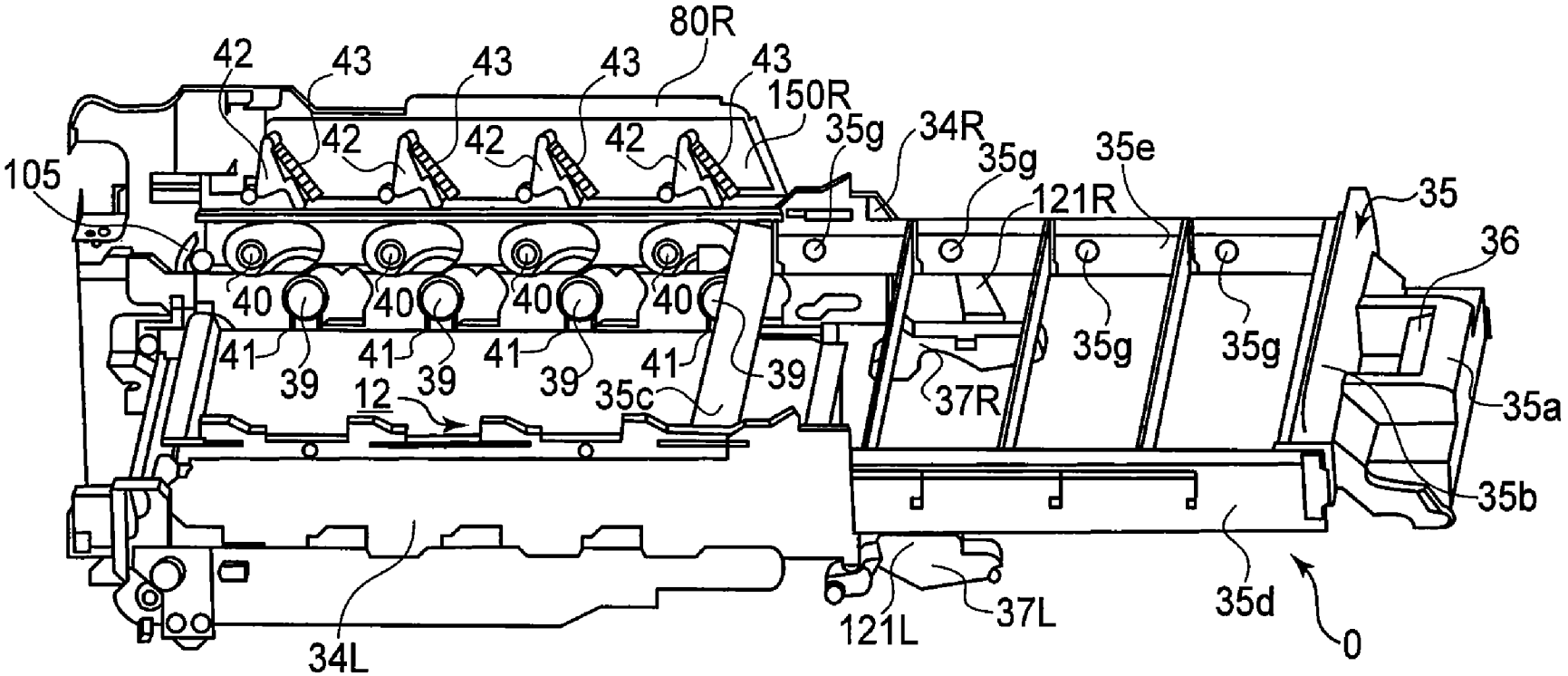
FIG. 9A is a perspective view for illustrating the interface portion, to be located in the neighborhood of the cartridges, to be released in interrelation with movement of the tray holding member.
Figure 9B:
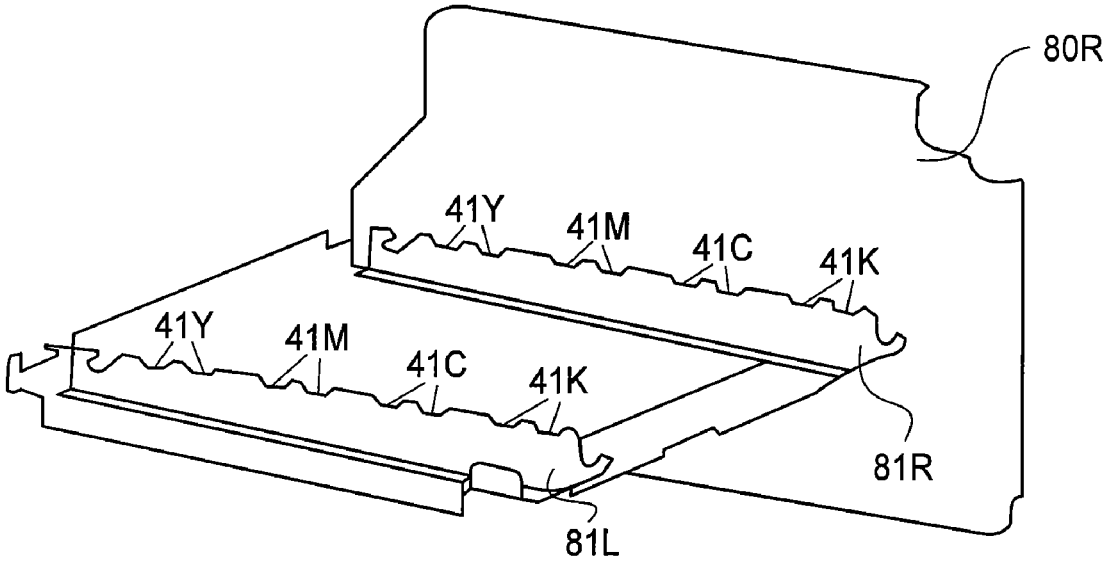
FIG. 9B is a perspective view for illustrating a constitution of a stay for positioning the developing cartridge and the drum cartridge.
Figure 10A:
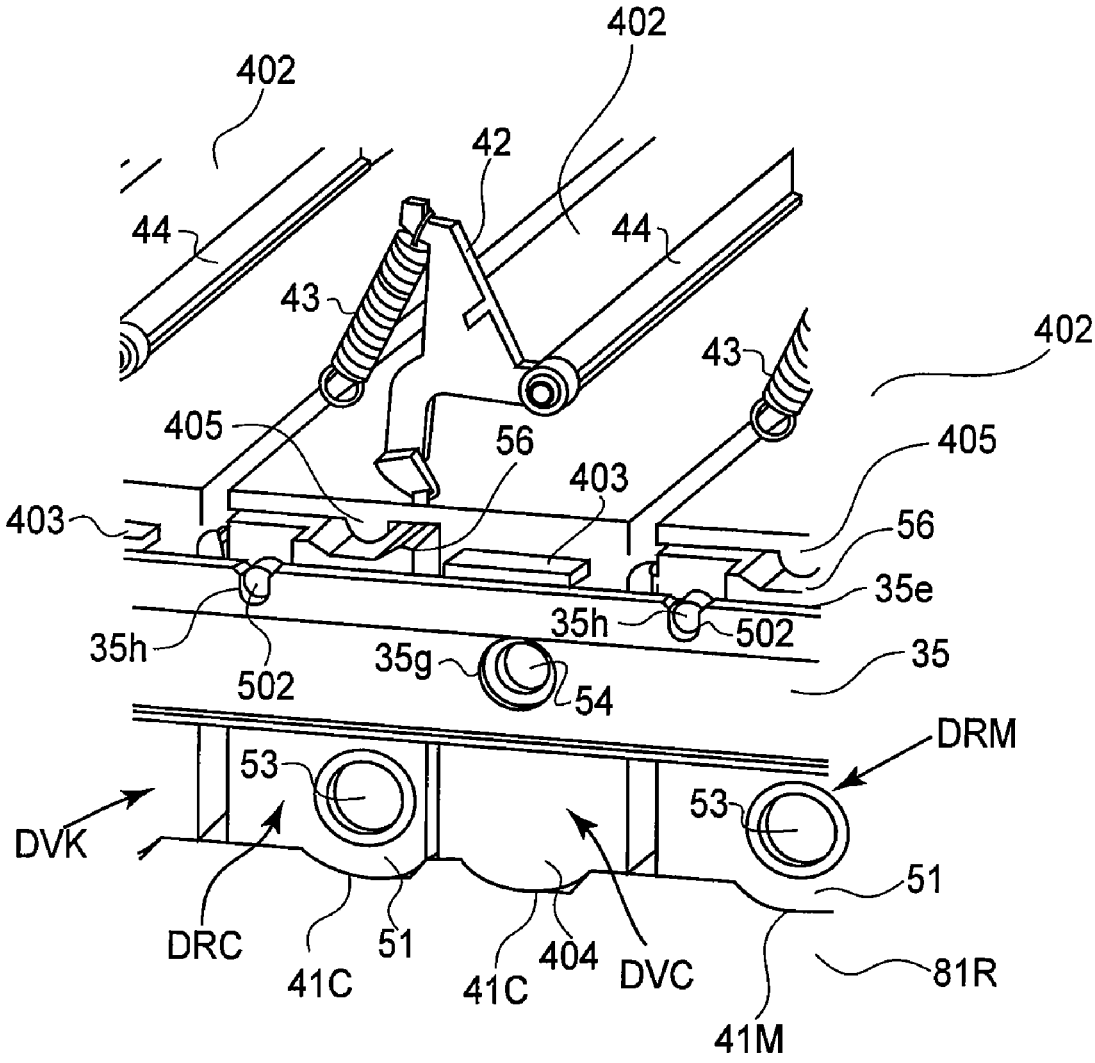
FIG. 10A is a perspective view for illustrating a state in which the developing cartridge and the drum cartridge are positioned in an apparatus main assembly.
Figure 11:
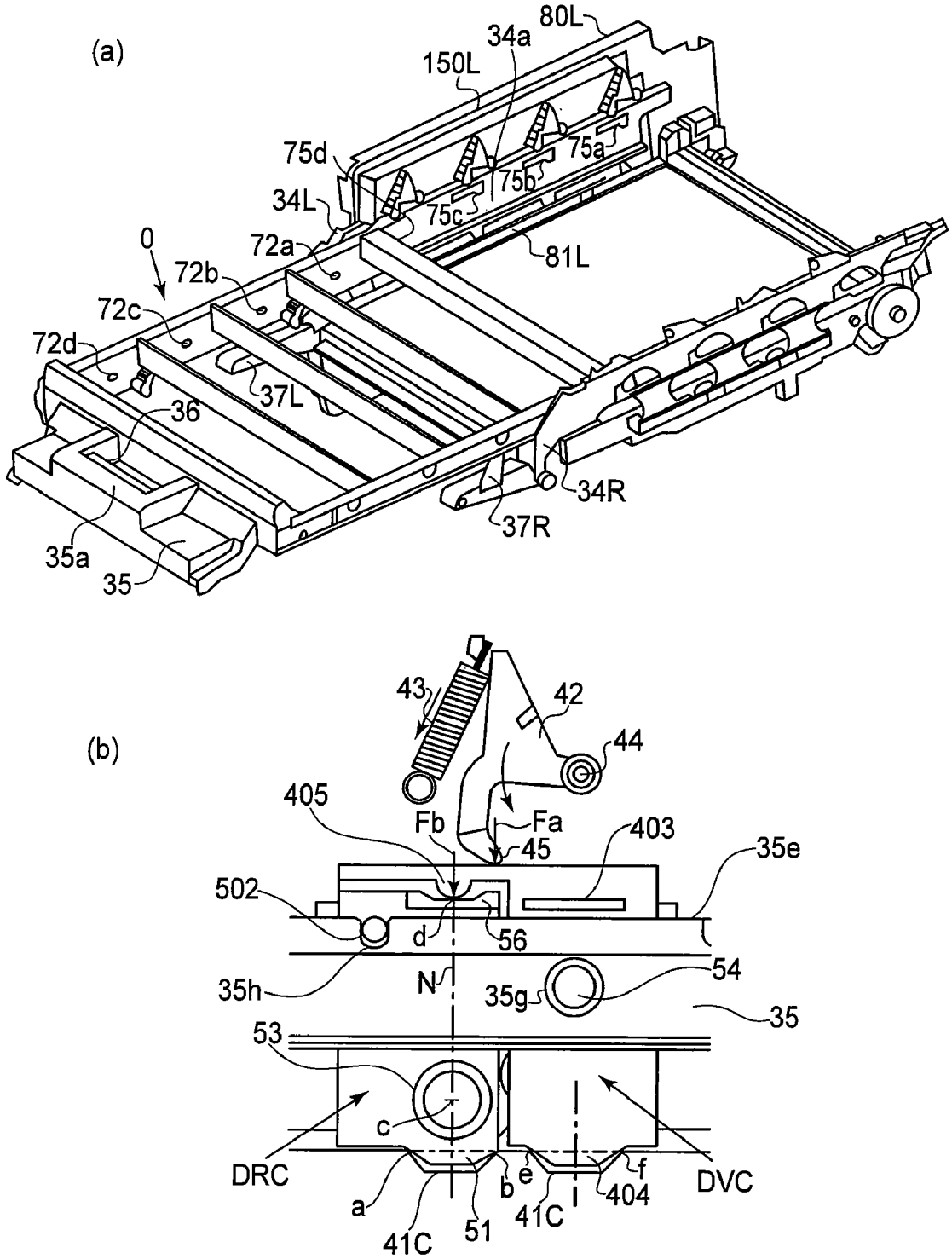
FIG. 11(*a*) is a perspective view for illustrating a state in which the tray and a frame of the image forming apparatus from which the tray is pulled out, and FIG. 11(*b*) is a side view for illustrating a state in which the developing cartridge and the drum cartridge are positioned in the apparatus main assembly.

FIGS. 8(*b*) and 9A are schematic views for illustrating interface portions, located in the neighborhood of the cartridges, to be disengaged or released in interrelation with the movement of the holding members 34L and 34R moved frontward and upward by a predetermined distance in interrelation with the opening rotational movement of the door 31. FIG. 8(*b*) shows a state in which the door 31 is closed as shown in FIGS. 1A and 1B under a condition of no cartridge. FIG. 9B shows a state in which the door 31 is opened and then the tray 35 is pulled out to the outside position O as shown in FIG. 3B and FIG. 4A. FIG. 9B is a perspective view for illustrating a constitution of a stay for positioning the cartridges DR and DV. FIG. 10A shows a state in which the cartridge DRC and the cartridge DRV are mounted to the tray 35 and are accommodated in the apparatus main assembly 100A. FIG. 11(*a*) is a perspective view for illustrating a state of the tray 35 pulled out to the outside position O and a state of the frame 80. On the right side (the driving side) of the inside of the apparatus main assembly 100A, the drum driving coupling 39 and the developing device coupling 40 as the drive output portions are provided. These couplings are connected to the cartridge-side drive input portions 53 and 54 (FIG. 7(*c*)) to rotationally drive the drum 1 of each cartridge DR and the developing roller 4*a* of each cartridge DV. Inside the apparatus main assembly 100A, positioning portions 41 (41Y, 41M, 41C and 41K) are provided to the stay members 81R and 81L (FIG. 9B) of the apparatus main assembly 100A at right and left end portions of the apparatus main assembly 100A. These position portions 41 receive and stop lower surface portions 404 (portions to be positioned) of the shaft supporting portions on the driving side and on the non-driving side of each cartridge DV and lower surface portions 51 (portions to be positioned) of the shaft supporting portions on the driving side and on the non-driving side of each cartridge DR. Further, in order to engage and fix the above-described lower surface portions 404 and 51 in the positioning portions 41, urging members 42 for urging the driving-side upper surface and the non-driving-side upper surface of the cartridge DV are provided. To each urging member 42, an urging spring 43 is provided for generating an urging force. To the cartridge DR, the urging force is applied against the coil spring 501 (FIG. 7(*a*)).

Figure 12:
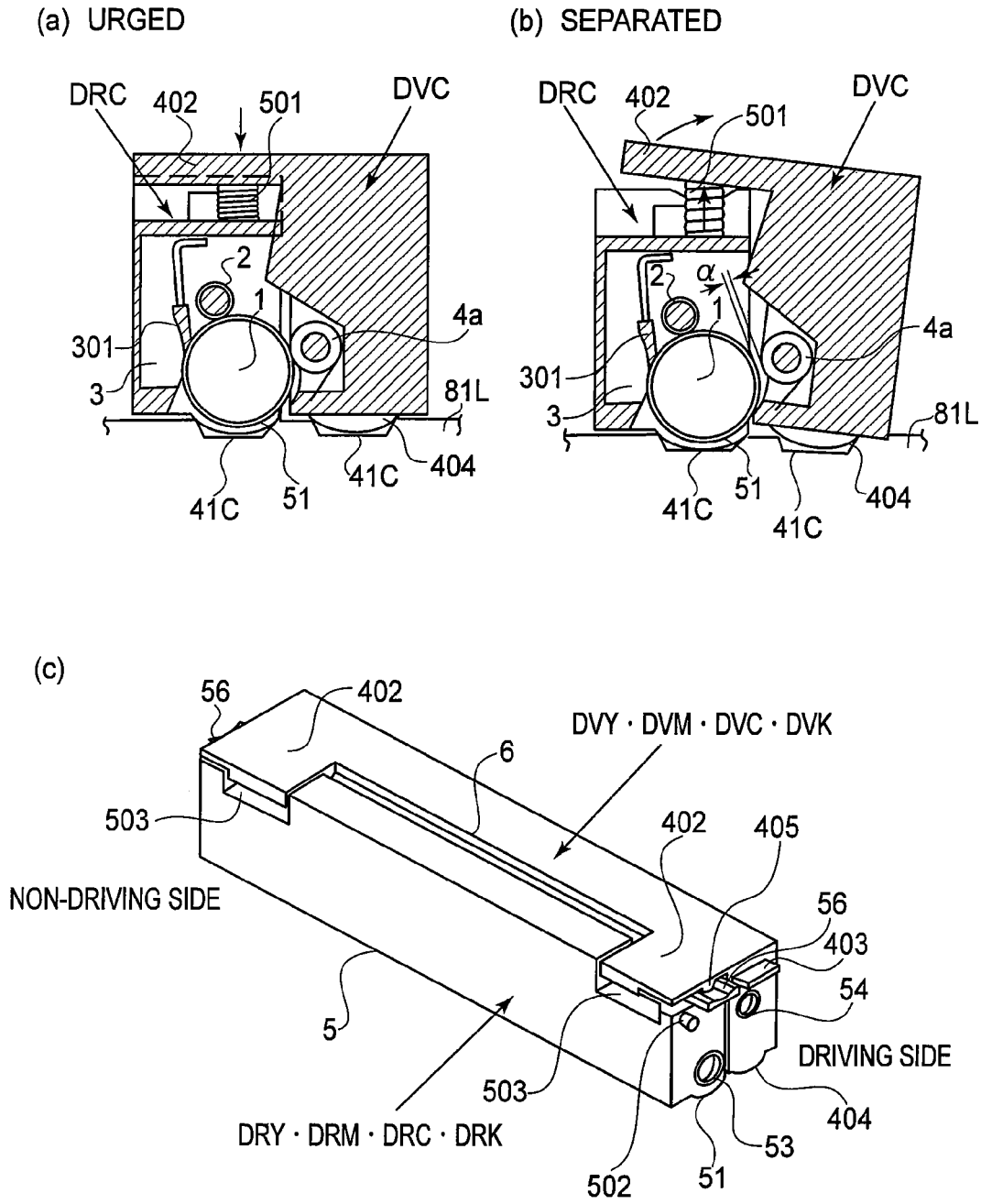
FIG. 12(*a*) is a cross-sectional view showing a state in which the developing cartridge is urged so that a developing roller of the developing cartridge contacts a drum of the drum cartridge, FIG. 12(*b*) is a cross-sectional view showing a state in which the urging of the developing cartridge is released to separate the developing roller from the drum of the drum cartridge, and FIG. 12(*c*) is a perspective view showing a state in which the developing cartridge and the drum cartridge are disposed in combination in Embodiment 2.

The positioning of each cartridge DR and each cartridge DV to the apparatus main assembly 100A at the image forming position PS will be described with reference to FIGS. 11(*b*) and 12(*a*). The description will be made by taking the set of the cartridge DRC and the cartridge DVC as an example but this is true for other sets of the cartridges. The urging members 42 provided on the driving side and on the non-driving side are disposed in a bilaterally symmetrical manner and have the same structure. Referring to FIG. 11(*b*), the upper surface of the cartridge DVC are urged with an urging force Fa by a lever portion 45 of the urging member 42 urged by the urging spring 43 rotationally moved about a supporting point 44. In this urging state, the coil spring 501 (FIG. 7(*a*)) is compressed between the lower surface of the eave 402 of the cartridge DVC and the upper surface of the cartridge DRC (FIG. 12(*a*)). Further, a projection 405 provided to the lower surface of the eave 402 press-contacts the upper surface of the eaves 56 of the cartridge DRC to urge the eaves 56 of the cartridge DRC with an urging force Fb. That is, the cartridge DRC is downwardly urged with the urging force Fb. By this urging with the urging force Fb, the lower surface portion 51 as the portion to be positioned of the cartridge DRC is urged against and tightly engaged in the positioning portion 41C on the stay member 81R side. In this embodiment, the lower surface portion 51 as the portion to be positioned of the cartridge DRC is an arcuate portion. The positioning portion 41C in which the lower surface portion 51 is to be engaged is a recess portion with both end portions slanting upwardly. The arcuate portion 51 engages in the recess 41C and is stopped at two points a and b at the upwardly slanting portions. In an urging and positioning state shown in FIG. 11(*b*). A contact portion d between the projection 405 and the eave 56 is located on a perpendicular bisector N of a line segment connecting the point a and the contact portion d and a line segment connecting the point b and the contact portion d. Further, the boss 502 provided to the cartridge DRC engages in the groove 35*h* provided to the tray 35. As a result, the cartridge DRC is prevented from being rotated. As described above, the cartridge DRC are stably positioned and fixed to the apparatus main assembly 100A. On the other hand, by the upper surface urging with the urging force Fa, by the urging member 42, the lower surface portion 404 of the cartridge DVC is urged against and tightly engaged in the associated positioning portion 41C on the stay member 81R side. In this embodiment, the lower surface portion 404 as the portion to be positioned of the cartridge DVC is an arcuate portion. The positioning portion 41C in which the lower surface portion 404 is to be engaged is a recess portion with both end portions slanting upwardly. The arcuate portion 404 engages in the recess 41C and is stopped at two points e and f at the upwardly slanting portions. Further, the projection 405 of the eave 402 press-contacts the eave 56 of the cartridge DRC. As a result, the cartridge DVC is prevented from being rotated. As described above, the cartridge DVC are stably positioned and fixed to the apparatus main assembly 100A. In a state in which the cartridge DRC and the cartridge DVC are positioned as described above, the developing roller 4*a* of the cartridge DVC is placed in contact with the drum 1 of the cartridge DRC in a predetermined manner (FIG. 12(*a*)). FIG. 12(*b*) shows a state in which the urging against the cartridge DVC by the urging member 42 is released. By the release of the urging, the lower surface portion 404 of the DVC is released from the tight engagement with the positioning portion 41C. Further, by a restoring force of the coil spring 501, the DVC is rotationally moved about the engagement portion between the lower surface portion 404 and the positioning portion 41C in a direction opposite from the cartridge DRC. By this rotational movement, the projection 405 is separated from the upper surface of the eave 45 of the cartridge DRC. As a result, the urging against the cartridge DRC is also released, so that the tight engagement between the lower surface portion 51 and the positioning portion 41C is released. Thus, the positioning fixation of the cartridge DRC and the cartridge DVC to the apparatus main assembly 100A is released. In this released state, the developing roller 4*a* of the cartridge DVC is separated from the drum 1 of the cartridge DRC by a predetermined distance $\alpha$. Therefore, when an unshown urging releasing mechanism is used, the urging by the urging member 42 is released except during the printing, so that image defect caused due to deformation by the contact of the developing roller 4*a* with the drum 1 for a long time can be prevented.

Figure 10B:
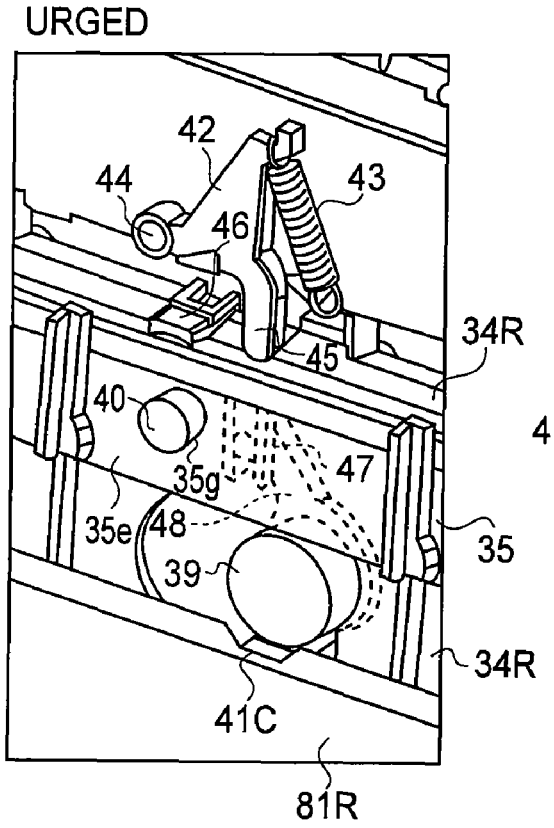
FIGS. 10B and 10C are perspective views for illustrating the interface portion, located in the neighborhood of the cartridges, to be released in interrelation with movement of the cartridge holding member in Embodiment 1.
Figure 10C:
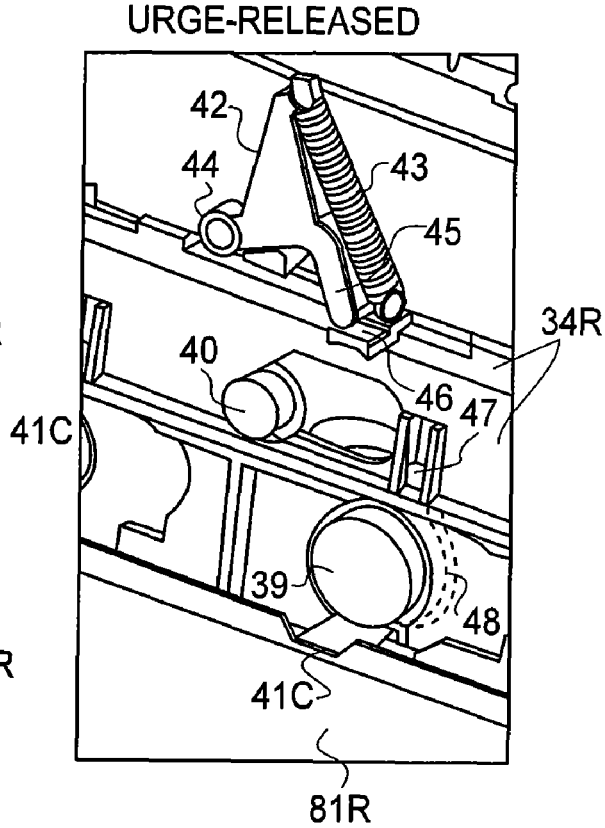

FIG. 10B is a partly enlarged view of the urging member 42, the drum drive coupling 39, and the developing device drive coupling 40 in the state shown in FIG. 8(*b*). FIG. 10C is a partly enlarged view of the urging member 42, the drum drive coupling 39, and the developing device drive coupling 40 in the state shown in FIG. 9A. The urging member 42 is rotatably movable about the supporting point 44 and is provided to the apparatus main assembly 100A. The urging member 42 urges the upper surfaces of the left and right side and portions of the cartridge DV with the urging member lever portion 45 by the spring force of the urging spring 43. In the urge-released state of FIG. 10C, the lever portion 45 is raised by an urging member raising portion 46 provided to the holding member 34R, the urging against the cartridge DV is released in interrelation with the motion of the holding member 34. A releasing lever pin 47 is provided to a releasing lever 48 (a drive disconnecting means for disconnecting the drive of the cartridge) provided around the coupling 39 in order to backward move the drum drive coupling 39. The pin 47 is moved from the position of FIG. 10B to the position of FIG. 10C in interrelation with the motion of the holding member R. By the operation of the lever 48 by this movement, the coupling 39 and the coupling 40 are backward moved to the positions of FIG. 10B. That is, the coupling between the coupling 38 and the cartridge DR and the coupling between the coupling 40 and the cartridge DV are released. In the state of FIG. 10A, i.e., in the state in which the coupling 39, the coupling 40, and the urging member 42 are released in interrelation with the motion of the holding members 34R and 34L, the tray is freely slidable. Therefore, the tray 35 is placed in a state in which it can be accommodated in and pulled out from the apparatus main assembly 100A while holding the cartridges. As described above, with respect to the apparatus 100 in this embodiment, in the pull-out mode, the user can easily perform exchange of the consumables such as the cartridge DR and the cartridge DV. Further, it is also possible to prevent the drum cartridge, which does not reach the end of its lifetime, from being erroneously exchanged by the user.

[Embodiment 2]

Figure 13:
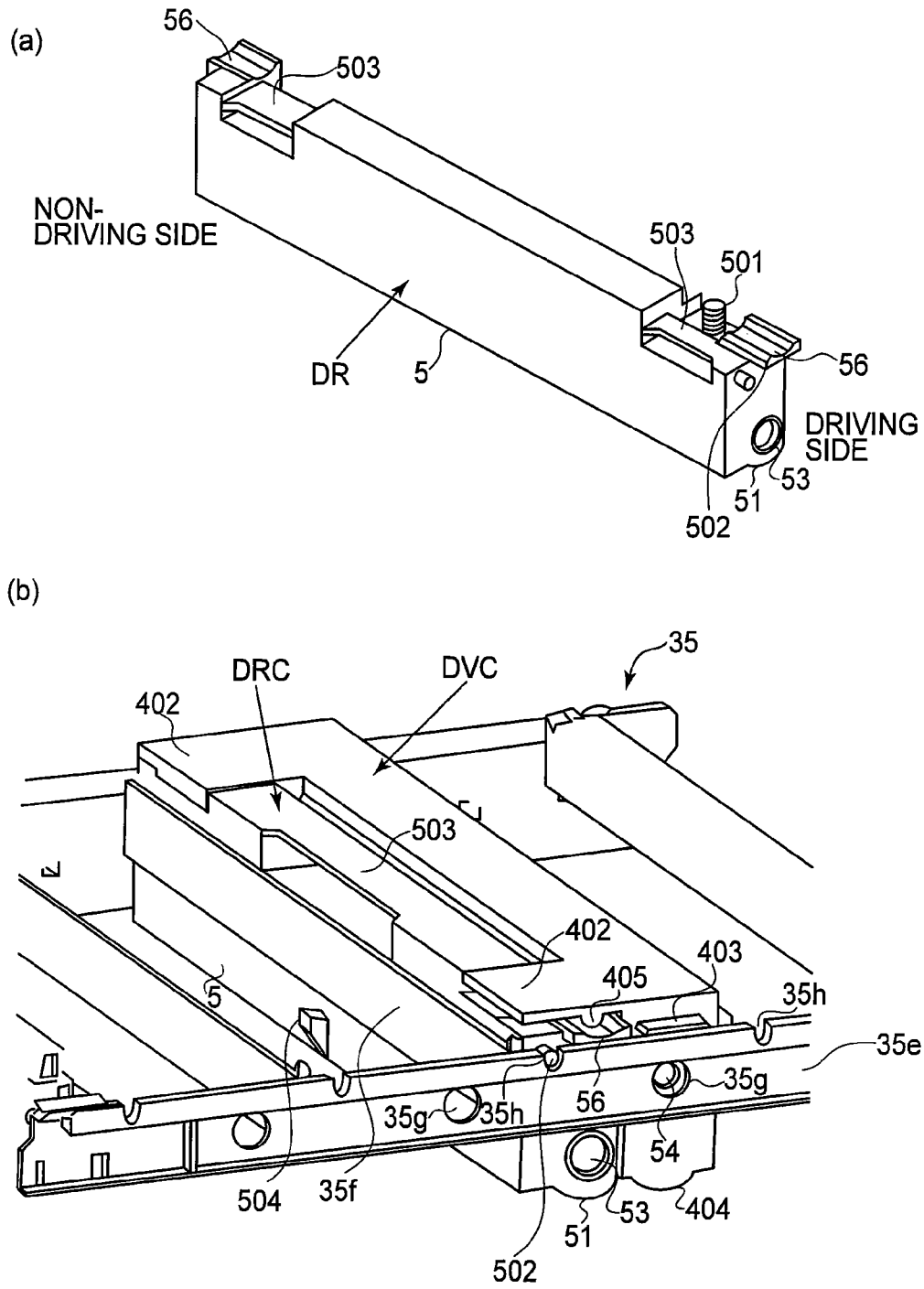
FIG. 13(*a*) is a perspective view of an outer appearance of the drum cartridge in Embodiment 2, and FIG. 13(*b*) is a perspective view for illustrating a state in which the drum cartridge and the developing cartridge are mounted in a state in which the tray is pulled out.

In Embodiment 2, as shown in FIG. 12(*c*) and FIG. 13(*a*), a grip 503 for gripping the cartridge DR by the user is provided to the cartridge DR and only the grip 503 is covered with the eave 402 of the cartridge DV. That is, the grip 503 provided to the cartridge DR is covered with the cartridge DV. Therefore, the demounting of the cartridge DR by using the grip 503 can only be performed after the cartridge DV is demounted in advance, so that the erroneous exchange by the user of the cartridge DV which does not reach the end of its lifetime is prevented. FIG. 12(*c*) shows a state in which the cartridge DR and the cartridge DV are placed on the tray 35 (not shown). FIG. 13(*a*) shows the cartridge DV alone. In this embodiment, the eave 402 as the preventing member is provided to the cartridge DV so as to project over an area connecting both longitudinal ends of the cartridge DR in the state in which the cartridge DR and the cartridge DV are supported by the tray 35. The cartridge DR and the cartridge DV are configured to be upwardly demounted from the tray 35. The eave 402 is provided to the cartridge DV so as to project over the grip 503, which is provided to the cartridge DR and is gripped by the user when the cartridge DR is demounted from the tray 35, in the state in which both the cartridge DR and DV are supported by the tray 35. The eave 402 prevents the grip 503 from being gripped by the user, when the user intends to grip the grip 503 in order to upwardly demount the cartridge DR from the gray 35, in the state in which the cartridge DV is supported by the tray 35. As a result, the cartridge developing roller is prevented from being demounted. The grip 503 is provided to the upper surface of the cartridge DR in the state in which the cartridge DR is supported by the tray 35, and the eave 402 is provided to the cartridge DV so as to project above the grip 503.

[Embodiment 3]

Figure 14:
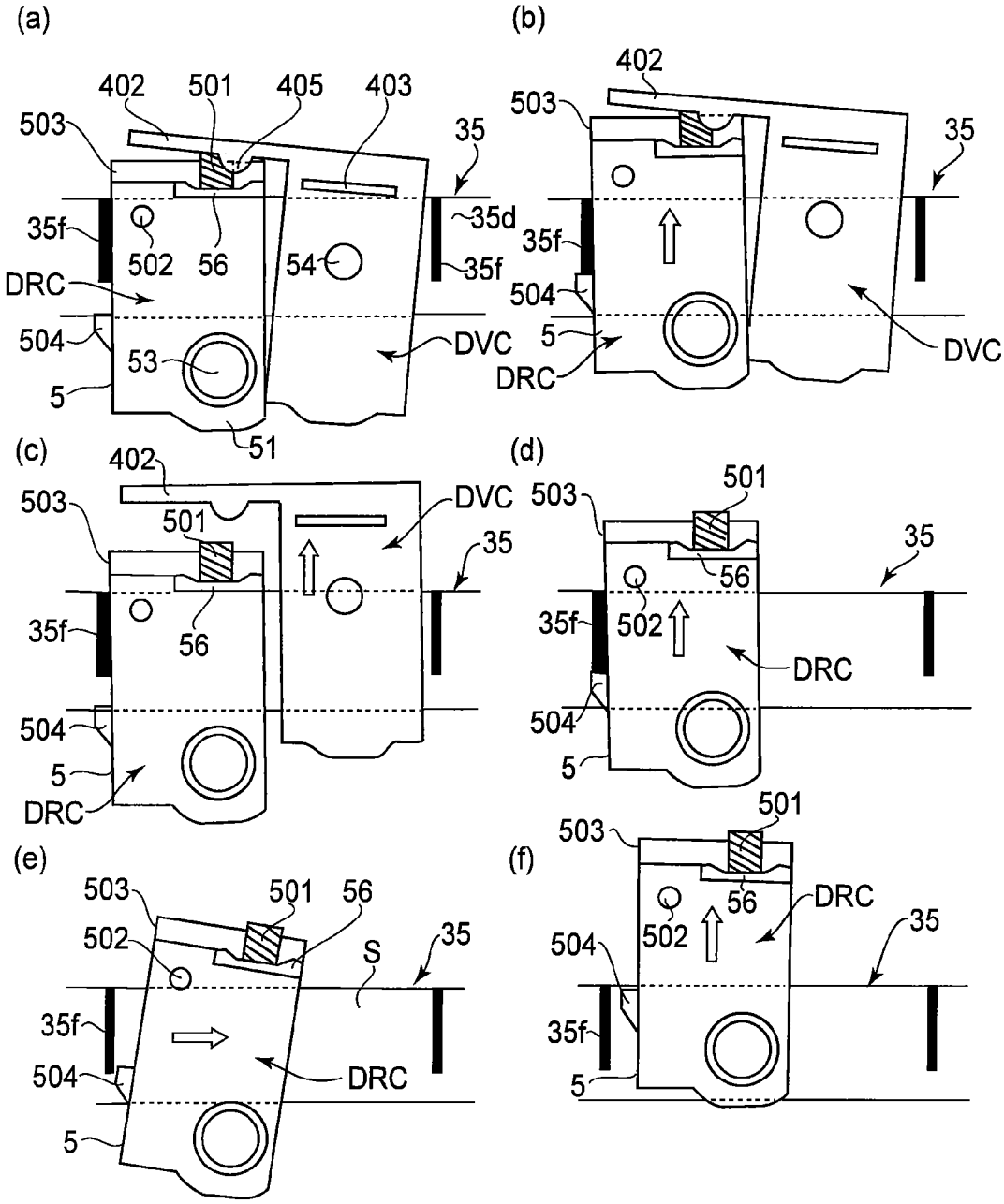
FIGS. 14(*a*) to 14(*f*) are schematic views for illustrating a demounting procedure of the drum cartridge.

FIG. 13(*b*) and FIGS. 14(*a*) to 14(*f*) are schematic views for illustrating Embodiment 3. Description will be made by taking the set of the cartridge DRC and the cartridge DVC as an example but this is true for other sets of the cartridges. In this embodiment, in the state in which the cartridge DRC and the cartridge DVC are supported by the tray 35, a stopper shape portion 504 as the preventing member for preventing the cartridge DRC from being demounted from the tray 35 is provided to the cartridge DRC. The stopper shape portion 504 is provided so as to outwardly project from the outer surface of the drum cartridge frame 5. The cartridge DRC and the cartridge DVC are configured to be upwardly demounted from the tray 35 and the tray 35 is provided with the stay portion 35*f* as the engaging portion with the above-described stopper shape portion 504. FIG. 13(*b*) and FIG. 14(*a*) shows a state in which the tray 35 is pulled out to the outside position O and supports the cartridge DRC and the cartridge DVC. When the cartridge is started to be upwardly demounted from the tray 35 in this state, the stopper shape portion 504 contacts the stay portion 35*f* as shown in FIG. 14(*b*) to prevent the demounting of the cartridge DRC. The cartridge DRC can only be demounted from the tray 35 while moving the stopper shape portion 504 so as to avoid the stay portion 35*f* after the cartridge DVC is demounted from the tray 35 in advance. Even when the user grips the grip 503 and raises the cartridge DRC without demounting the cartridge DVC in advance, the stopper shape portion 504 interferes with the stay portion 35*f* to prevent the raising of the cartridge DRC. Therefore, the developing cartridge DV which does not reach the end of its lifetime is prevented from being erroneously demounted from the tray 35 by the user. In the case of demounting the cartridge DRC, first, the cartridge DVC is demounted from the tray 35 by being raised as shown in FIG. 14(*c*). Then, by gripping the grip 503 of the cartridge DRC and raising the cartridge DRC as shown in FIG. 14(*d*), the boss 503 for stopping the rotation is placed in a state in which the boss 502 is disengaged from the tray 35—side groove 35*h*. Then, the cartridge DRC is moved toward a space S, in which the cartridge DVC was supported by the tray 35, as shown in FIG. 14(*e*). As a result, the stopper shape portion 504 is moved away from the stay portion 35*f*. Thus, the stopper shape portion 504 is placed in the state in which it is moved away from the stay portion 35*f* and then the cartridge DRC is raised as shown in FIG. 14(*f*). As a result, the cartridge DRC is demounted from the tray 35.

The cartridge DRC and the cartridge DVC are arranged side by side and supported by the tray 35, and the stopper shape portion 504 is provided so as to outwardly project from the outer surface of the frame 5 provided along the longitudinal direction of the cartridge DRC. The stay portion 35*f* is provided above the stopper shape portion 504. The cartridge DRC is prevented from being moved in a direction perpendicular to the longitudinal direction by the cartridge DVC. When the cartridge DVC is demounted from the tray 35 earlier than the cartridge DRC in the state in which the cartridge DRC and the cartridge DVC are supported by the tray 35, the cartridge DRC can be moved toward the space state in which the cartridge DVC has been supported by the tray 35 (FIG. 14(*e*)). For that reason, even when the cartridge DRC is upwardly demounted from the tray 35, the stopper shape portion 504 does not contact the stay portion 35*f* (FIG. 14(*f*)).

[Embodiment 4]

Figure 15:
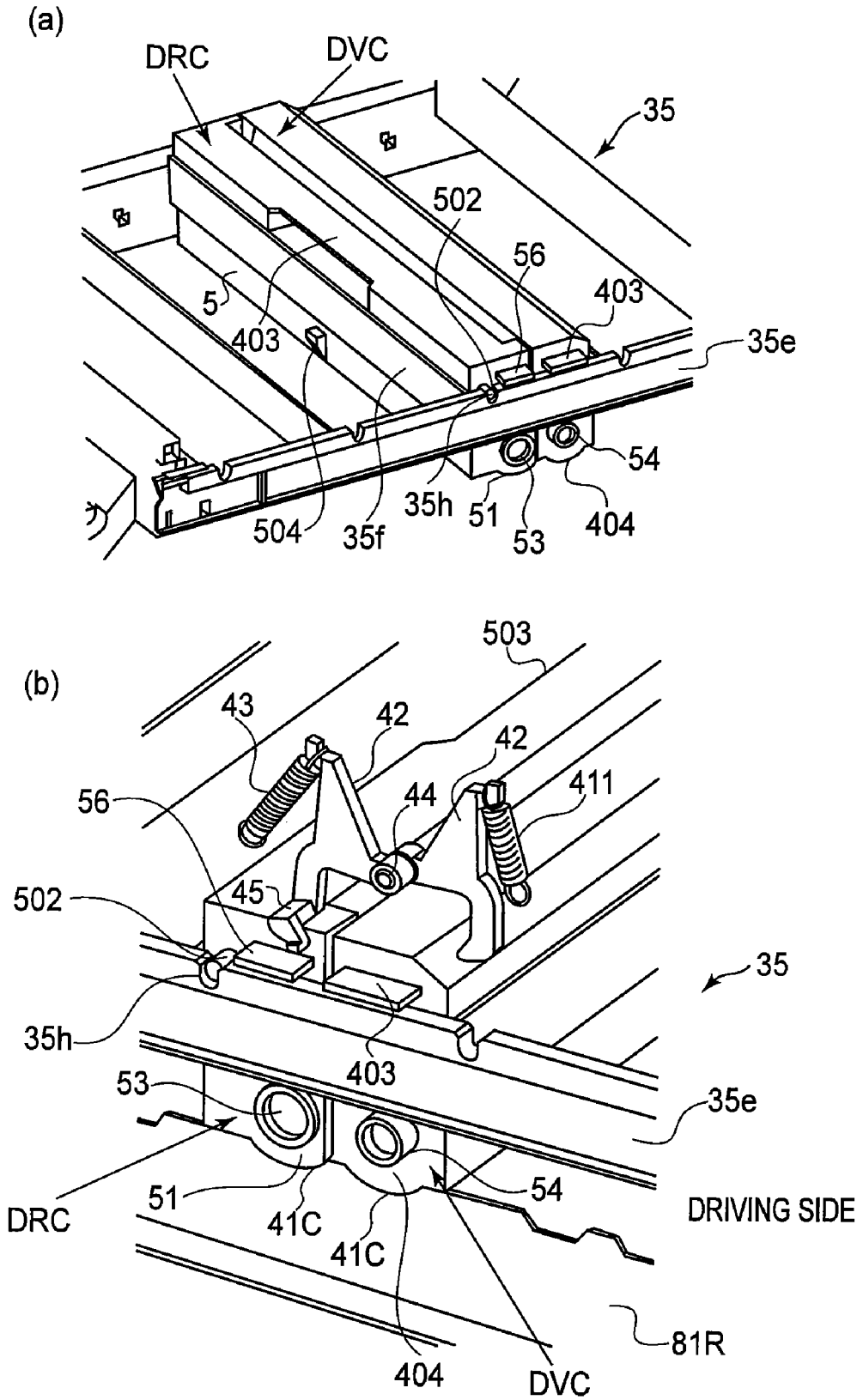
FIG. 15(*a*) is a perspective view for illustrating a state in which the drum cartridge and the developing cartridge are mounted in a state in which the tray is pulled out in Embodiment 3, and FIG. 15(*b*) is a perspective view for illustrating a state in which the developing cartridge and the drum cartridge are positioned in the apparatus main assembly.
Figure 16:
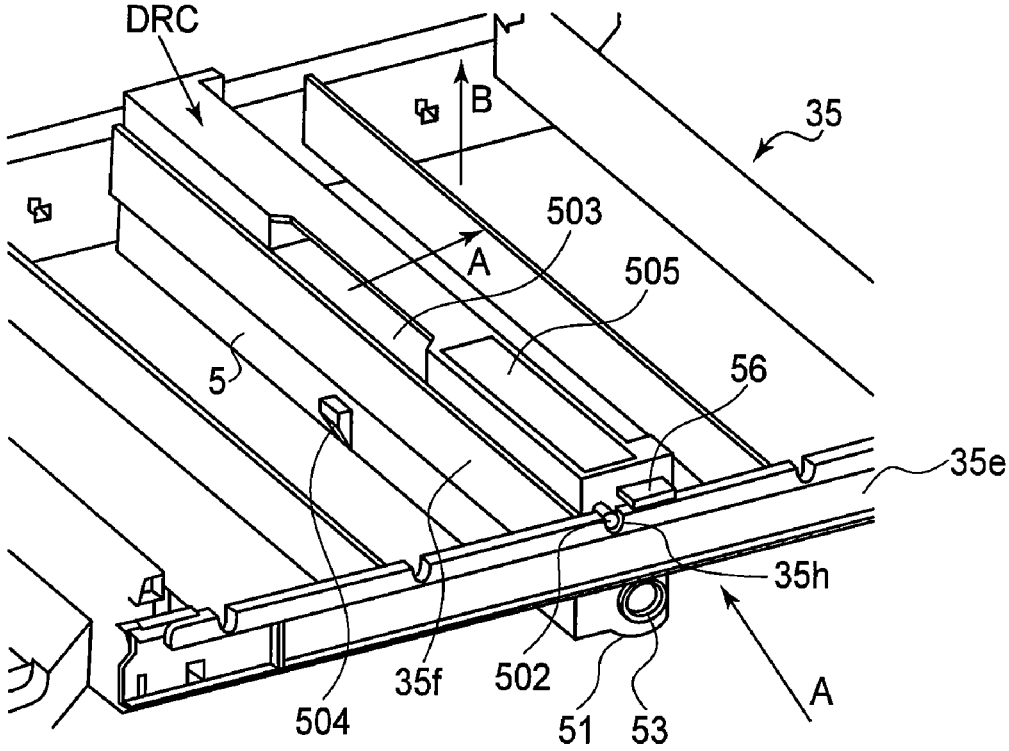
FIG. 16(*a*) is a perspective view for illustrating a manner of demounting the drum cartridge, and FIG. 16(*b*) is a perspective view showing a state in which the drum cartridge and the developing cartridge are disposed in combination.
Figure 16:
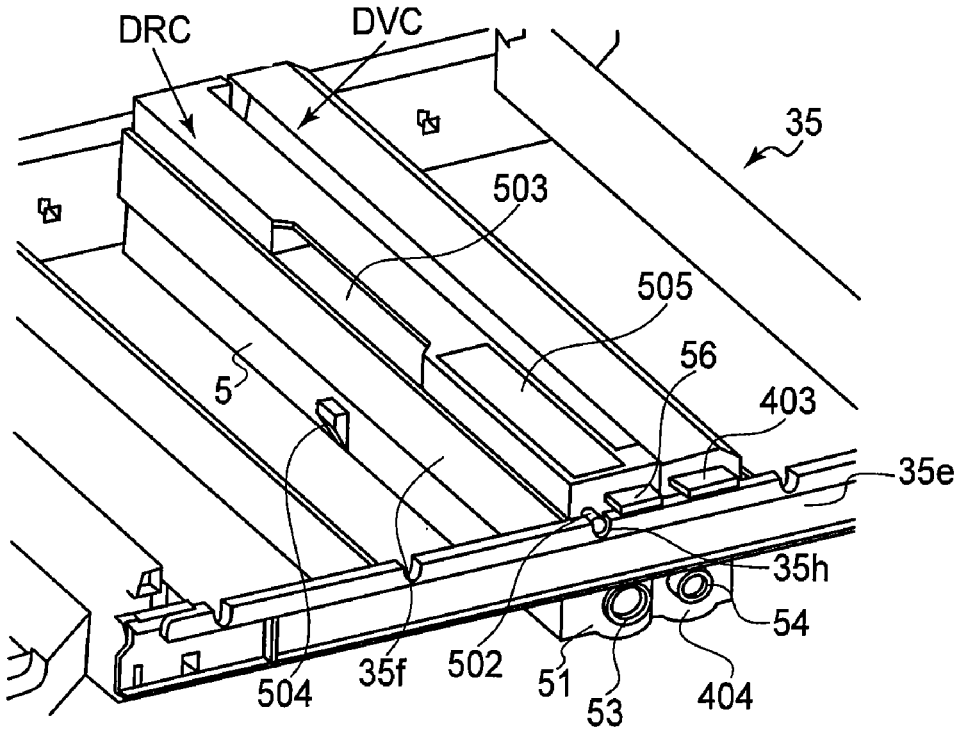
Figure 17:
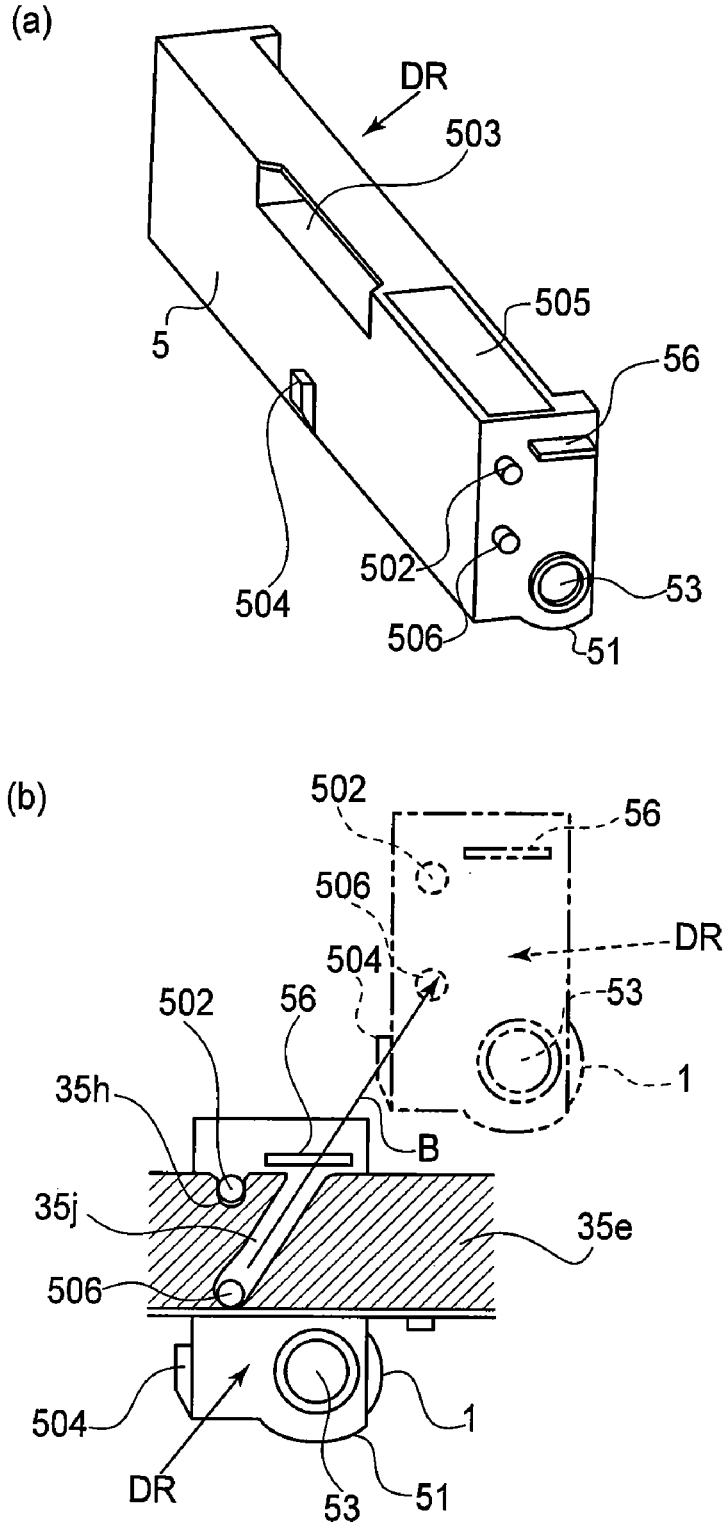
FIG. 17(*a*) is a perspective view of the drum cartridge, and FIG. 17(*b*) is a schematic view for illustrating a demounting manner of the drum cartridge.

In the apparatus constitution in Embodiment 3, the cartridge DR is not necessary to be covered with the cartridge DV from above. FIG. 15(*a*) shows a state in which the cartridge DR and the cartridge DV are mounted to the tray 35 in the embodiment in which the cartridge DR is not covered with the cartridge DV from above. Description will be made by taking the set of the cartridge DRC and the cartridge DVC as an example but this is true for other sets of the cartridges. Similarly as in Embodiment 3, the cartridge DRC can only be demounted from the tray 35 while moving the stopper shape portion 504 so as to avoid the stay portion 35*f* after the cartridge DVC is demounted from the tray 35 in advance. In the embodiment shown in FIG. 15(*a*) in which the cartridge DRC is not covered with the cartridge DVC from above, not only the urging mechanism for the cartridge DRC but also the urging mechanism for the cartridge DVC are required. FIG. 15(*b*) shows a state in which the cartridge DRC and the cartridge DVC are mounted to the tray 35 and are accommodated in the apparatus main assembly 100A in the embodiment in which the urging mechanism for the cartridge DVC is added. For simplicity, only the corresponding ones of the urging members 42 and 410 and the urging springs 43 and 411 will be described. In the state in which the tray 35 is accommodated in the apparatus main assembly 100A, the upper surface of the tray 35 is separated from the lower surface of the eave 56 of the cartridge DRC and the lower surface of the eave 403 of the DVC. With respect to the cartridge DRC, the lower surface portions 51 of the driving-side shaft support portion and the non-driving-side shaft supporting portion are downwardly urged against the positioning portions 41C, provided to the stay members 81L and 81R of the apparatus main assembly 100A, by the urging member 42 with an urging force Fa (FIG. 22(*a*)) to be tightly engaged in the positioning portions 41C. The boss 502 is engaged in the groove 35*h* provided to the tray 35, so that the cartridge DRC is prevented from rotating and is positioned to the apparatus main assembly 100A. The lower surface portions 51 of the shaft supporting portions have a shape concentrically with the drum 1 and the coupling gear (engaging portion) 53, so that the drum 1 and the coupling gear 53 are positioned to the apparatus main assembly 100A with high accuracy, irrespective of positional accuracy of the groove 35*h*. The cartridge DVC is urged downwardly by the urging member 410 with a vertical component Fc1 of an urging force Fc (FIG. 22(*a*)). As a result, the lower surface portions of the driving-side and non-driving-side shaft supporting portions 404 of the cartridge DVC are urged against the position portions 41C provided to the stay members 81L and 81R of the apparatus main assembly 100A, thus being tightly engaged. Further, the cartridge DVC is rotated about the engaging portions 404 and 41 C toward the cartridge DRC side by a horizontal component Fc2 of the above-described urging force Fc. By optimizing the horizontal component Fc2 of the urging force Fc, the developing roller 4*a* is urged against the drum 1 with a proper urging force (FIG. 22(*a*)). Further, the lower surface portions 404 of the shaft supporting portions of the cartridge DVC are shaped concentrically with the shaft supporting portions, so that the coupling engaging portions 54 are positioned to the apparatus main assembly 100A with high accuracy, irrespective of the magnitude of the horizontal component Fc2 of the urging force Fc. In the embodiment in which the cartridge DRC is not covered with the cartridge DVC from above, it is hard to understand intuitively that the drum cartridge DRC cannot be demounted unless the developing cartridge DVC is demounted from the tray 35 in advance. Further, after the cartridge DVC is demounted, it is necessary to demount the cartridge DRC by moving the cartridge DRC in the upward direction (a direction of an arrow B indicated in FIG. 16(*a*)) while moving the DRC in a rearward direction (a direction of an arrow A indicated in FIG. 16(*a*)) so that the stopper shape portion 504 is not caught by the stay portion 35*f*. In order to get the above-described operation across to the user, as shown in FIGS. 16(*a*) and 16(*b*), an operation label 505 may be attached. Further, as shown in FIG. 17(*a*), the cartridge DR is provided with a guide pin 506. Further, as shown in FIG. 17(*b*), the tray 35 is provided with a guiding portion 35*j* for guiding the guide pin 506. As a result, the cartridge DR can be guided in a direction of an arrow B indicated in FIG. 17(*b*) in which the stopper shape portion 504 is not caught by the stay portion 35*f* and therefore the cartridge DR can be demounted from the tray 35.

Figure 18:
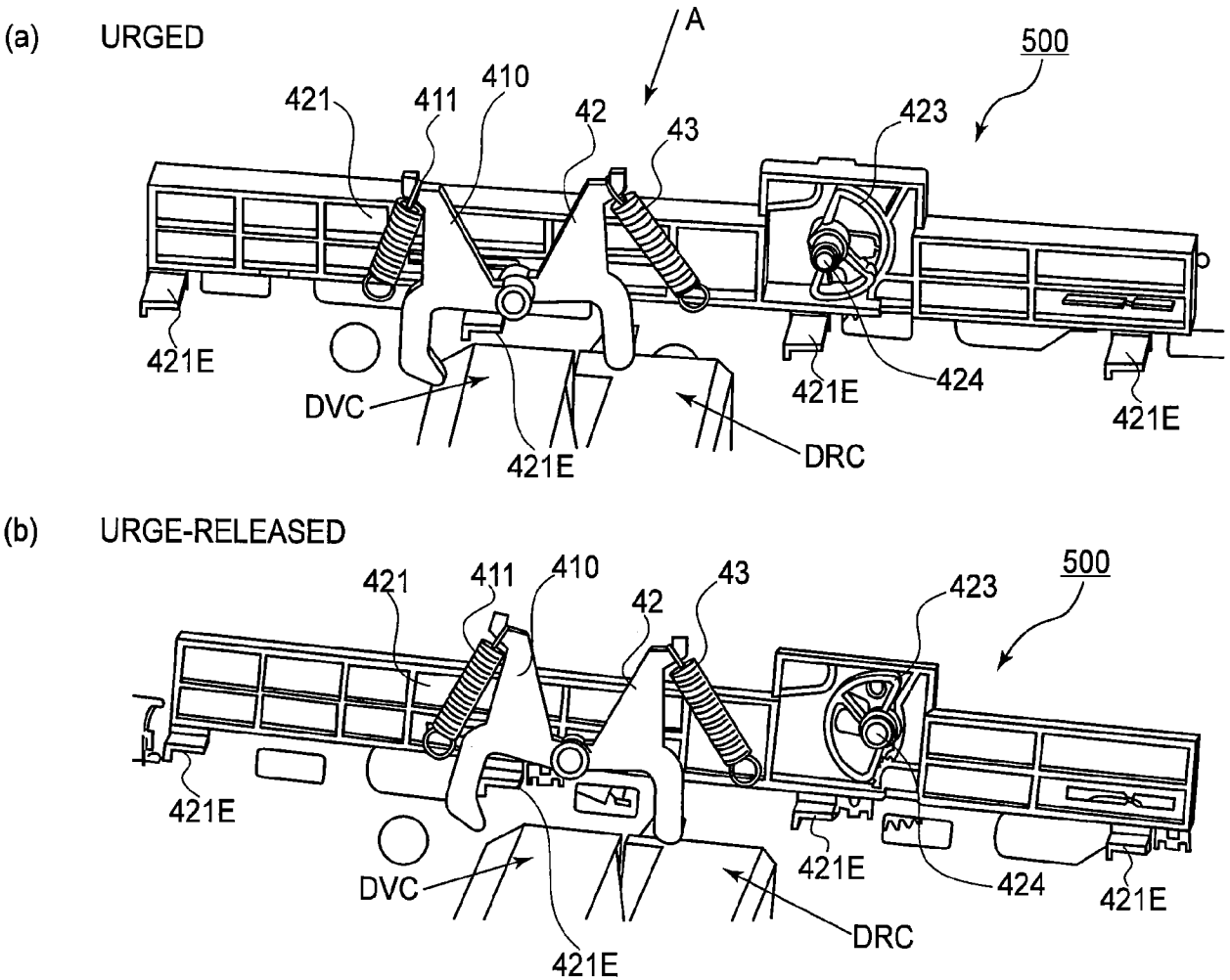
FIGS. 18(*a*) and 18(*b*) are perspective views specifically showing an urged state and an urge-released state of the developing cartridge, respectively.
Figure 19:
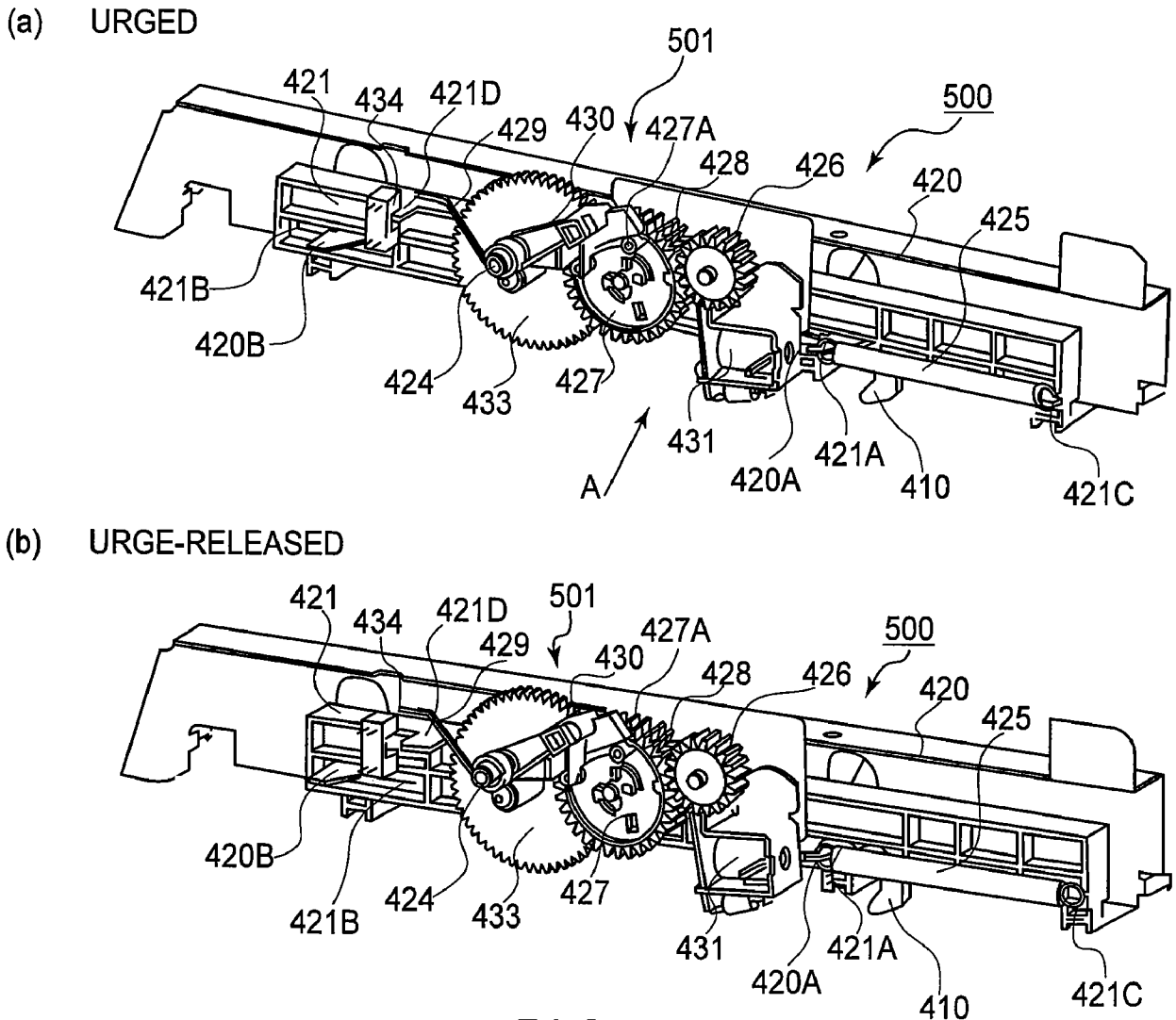
FIGS. 19(*a*) and 19(*b*) are side perspective views showing a driving mechanism for switching between the urged state and the urge-released state of the developing cartridge.
Figure 20:
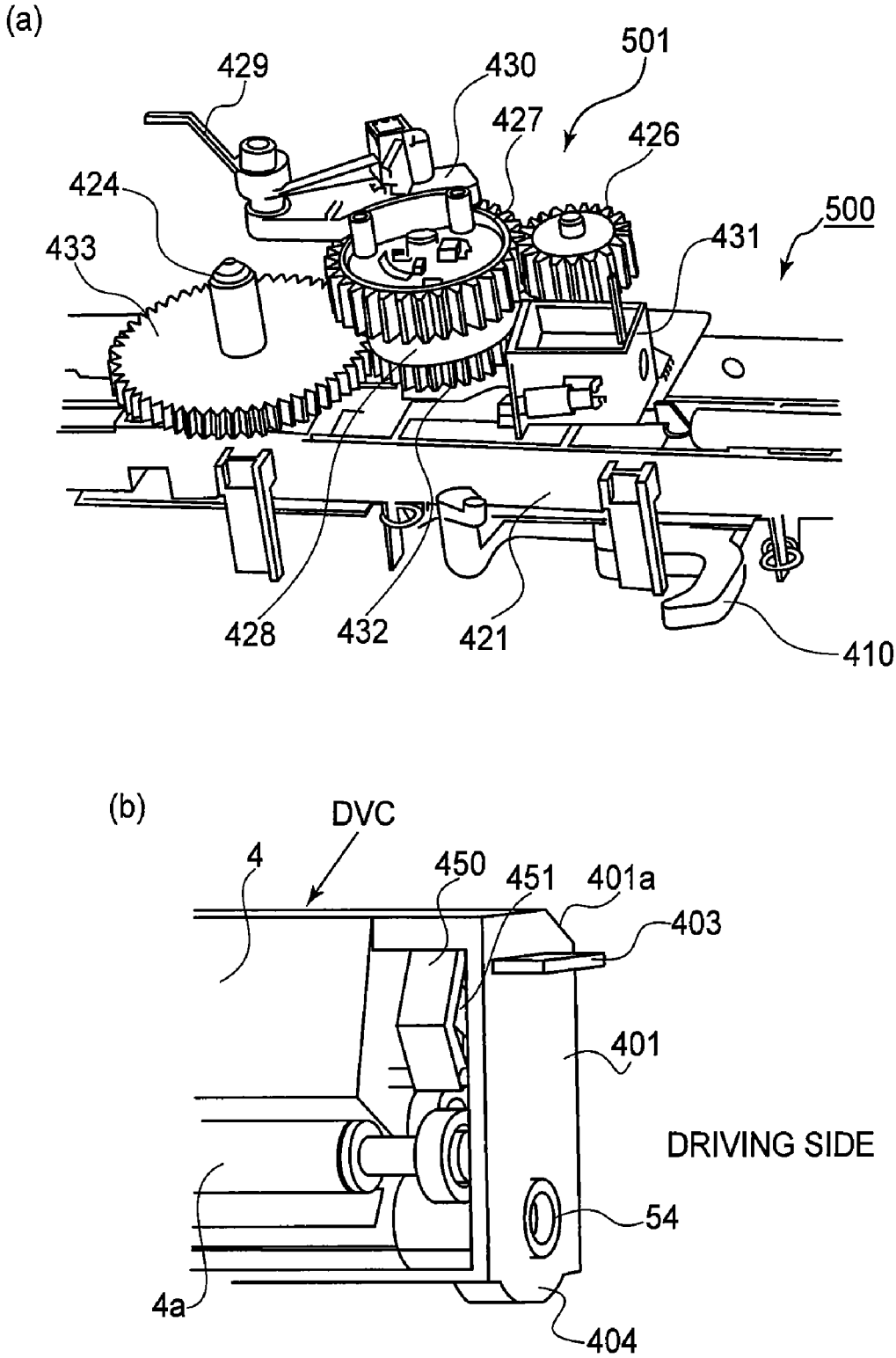
FIG. 20(*a*) is a bottom perspective view showing the driving mechanism for switching between the urged state and the urge-released state of the developing cartridge, and FIG. 20(*b*) is a perspective view of the developing cartridge provided with a mechanism for separating the developing roller from the drum in a state in which the urging of the developing cartridge is released.

With reference to FIGS. 18(*a*), 18(*b*), 19(*a*), 19(*b*), 20(*a*) and 20(*b*), an example of an urging releasing mechanism 500 for the urging mechanisms with respect to the cartridge DR and the cartridge DV. Description will be made by taking the set of the cartridge DRC and the cartridge DVC but this is true for other sets of the cartridges. FIGS. 18(*a*) and 18(*b*) are enlarged view showing the cartridges DRC and DVC and the neighborhood thereof. For simplicity, the urging members 42 and 410 which are not associated with the tray 35, the tray holding member 34R, a supporting metal plate 420, the left and right stay members 81L and 81R, and the cartridges DRC and DVC will be omitted from illustration in the figures. FIG. 18(*a*) show a state in which the cartridge DVC is urged by the urging member 410. When a releasing cam 423 is rotated 180 degrees and a releasing lever 421 is horizontally (backward) moved to the position shown in FIG. 18(*b*), a projection 421E provided to the releasing lever 421 rotationally moves the urging lever 410 against the force of the urging spring 411. As a result, the urging lever 410 is separated from the developing cartridge DVC to release the urging force applied to the cartridge DVC. This operation is similarly performed with respect to the cartridges DVY, DVM and DVK other than the cartridge DVC. FIGS. 19(*a*) and 19(*b*) are schematic views showing a driving mechanism 501 for horizontally moving the releasing lever 421 in the front-rear direction by rotating the releasing cam 423, as seen from a direction of an indicated arrow A. FIG. 19(*a*) shows a state in which the cartridge DVC shown in FIG. 18(*a*) is urged by the urging member 410. FIG. 19(*b*) shows a state in which the urging against the cartridge DVC shown in FIG. 18(*b*) by the urging member 410 is released. FIG. 20(*a*) is an enlarged view of a principal portion of the driving mechanism 501 as seen from a direction of the arrow A indicated in FIG. 19(*a*). Slit portions 421A and 421B of the releasing lever 421 are engaged with cut and erected portions 420A and 420B of the supporting metal plate 420. As a result, the releasing lever 421 is horizontally slidably supported by the supporting metal plate in the front-rear direction. The cut and erected portion 420A is provided with a hook-shaped portion connecting a coil spring 425 to a hook portion 421 C provided to the releasing lever 421. Principal constituent elements of the driving mechanism 501 will be described. The driving mechanism 501 includes a driving gear to which a driving force is to be transmitted from an unshown driving source and gears 427 and 428, having partly lacking tooth, to which the driving force is to be transmitted from the driving gear 426. The driving mechanism 501 also includes an urging lever 430 for urging a cam portion 427A of the gear 427 having partly lacking tooth by a force applied from a twist coil spring 429 and an electromagnetic solenoid 431 for effecting one rotation control of the gear 427 by engagement of a claw portion provided to the gear 428. The driving mechanism further includes a driving gear 423 engaged so as to be integrally rotated with the gear 427 and a cam gear 433 to be driven by the driving gear 432 and to be integrally rotated with the releasing cam (FIGS. 18(*a*) and 18(*b*)) through a shaft 424. The driving mechanism further includes a photo-interrupter 434 disposed at a position in which light is blocked or is not blocked by movement of a flag portion 421 C of the releasing lever 421. With reference to FIG. 20(*a*), an operation of one rotation control by the electromagnetic solenoid 431, the gear 427 and the gear 428 which have partly lacking tooth will be described.

When the power is turned on and a flapper of the electromagnetic solenoid is pulled, engagement of the flapper with a claw portion (not shown) of the gear 428 is released, so that the gear 428 and the driving gear 426 are in mesh by the urging force of coil springs (not shown) of the gears 427 and 428. When the gear 428 is driven and rotated by a predetermined angle, a stopper portion (not shown) is engaged with the gear 427 to rotate the gear 427 integrally with the driving gear 432, so that the cam gear 433 is driven and rotated. When the gear 428 is rotated one full turn, the flapper of the electromagnetic solenoid 431 to which the power input is turned off is engaged with the above-described claw portion (not shown) to stop the rotation. Further, by the urging lever 430, the rotation of the gear 428 is also stopped with the same rotational phase. The gears 427 and 428 have the same number of teeth and the number is ½ of that of the cam gear 433, so that the cam gear 433 is rotated 180 degrees depending on ON/OFF of the power input to the electromagnetic solenoid to switch between the urged state and the urge-released state. As shown in FIGS. 19(*a*) and 19(*b*), the photo-interrupter 434 can detect either one of the urged state and the urge-released state since the light is blocked in the urged state and is not blocked in the urge-released state depending on the state of the flag portion 421 C provided to the releasing lever 421.

Figure 21:
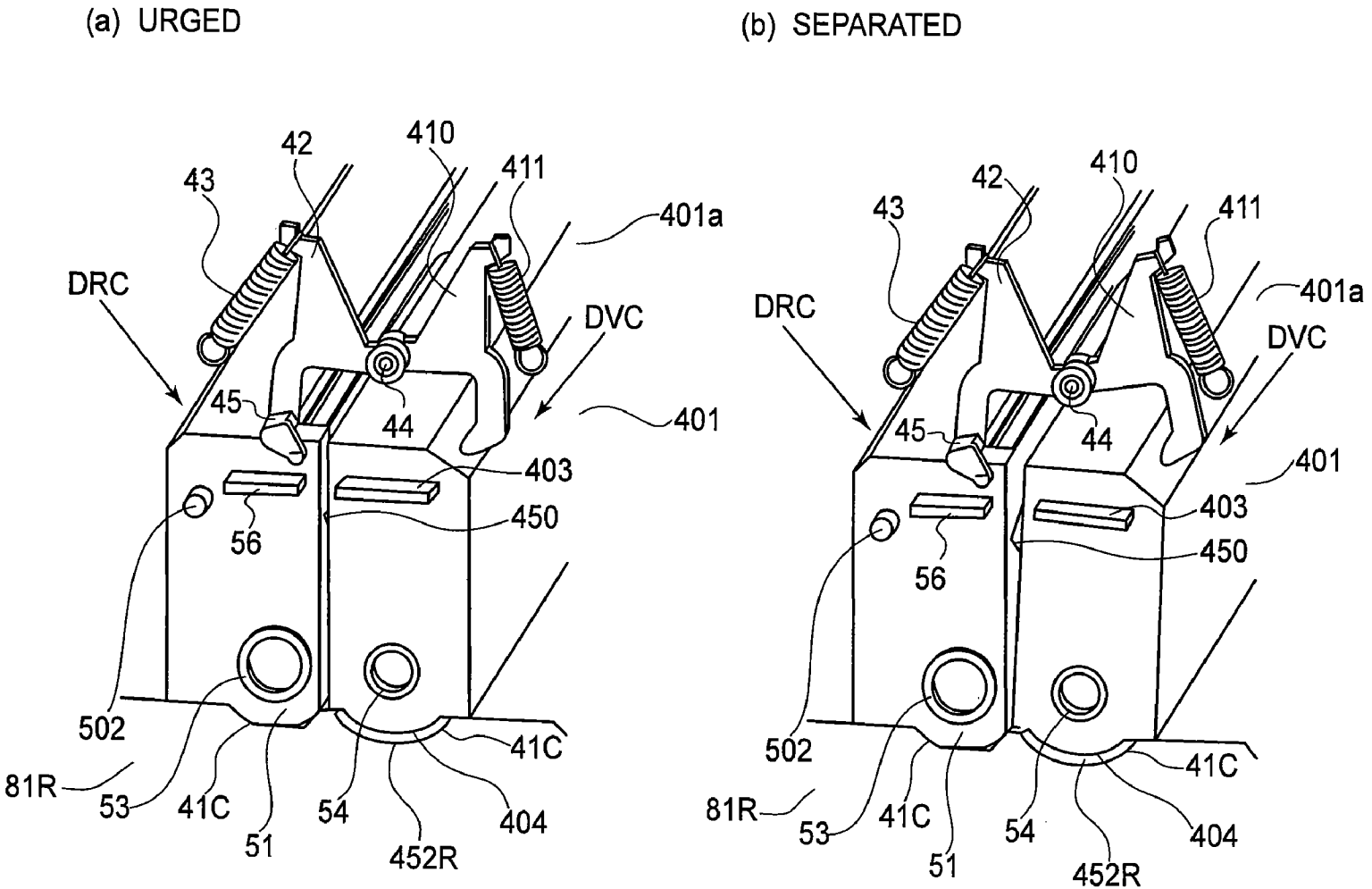
FIG. 21(*a*) is a perspective view showing the urged state of the developing cartridge, and FIG. 21(*b*) is a perspective view showing the urge-released state of the developing cartridge.
Figure 22:
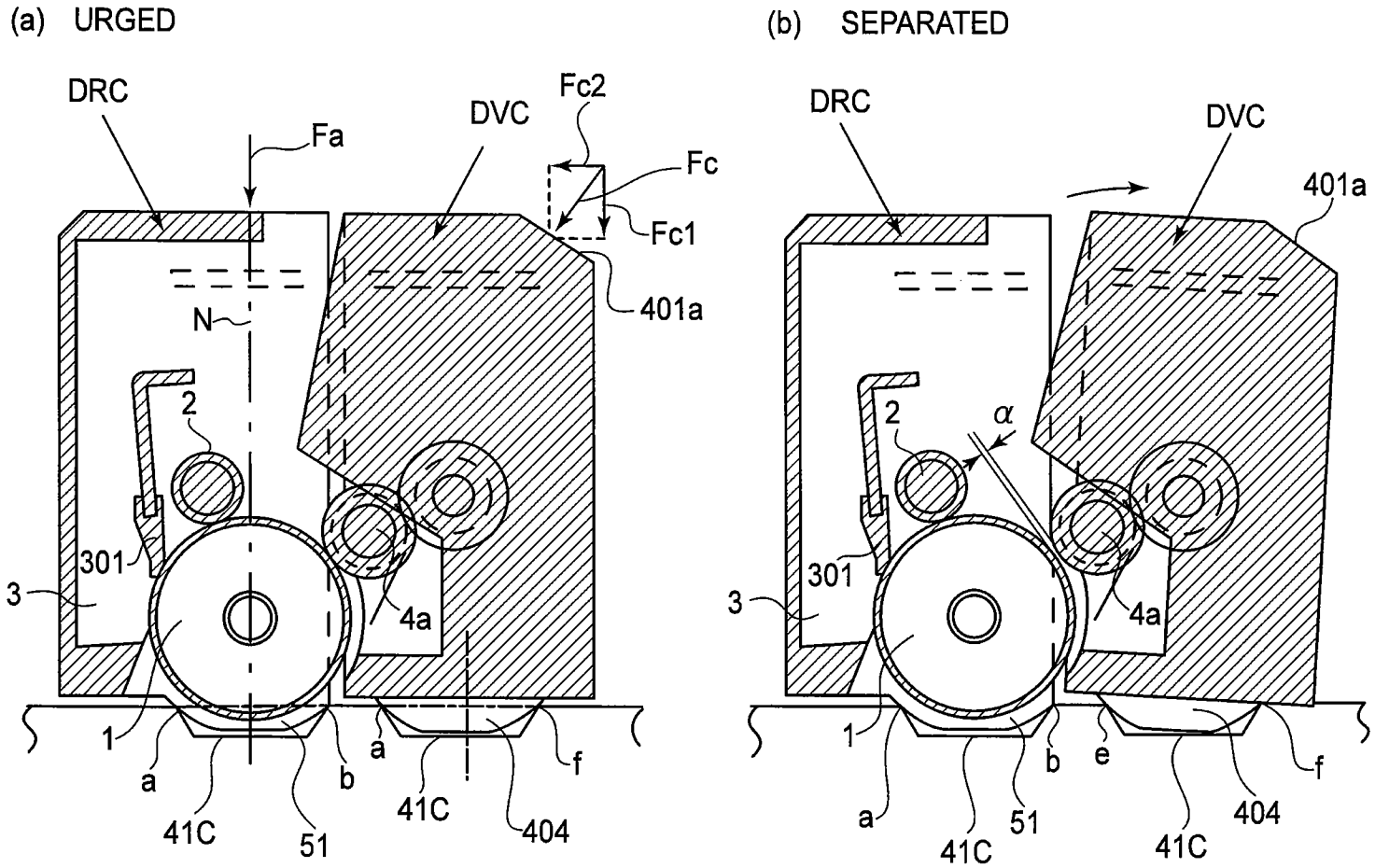
FIG. 22(*a*) is a sectional view showing a state in which the developing roller contacts the drum by urging the developing cartridge, and FIG. 22(*b*) is a sectional view showing a state in which the developing roller is separated from the drum by releasing the urging of the developing cartridge.

Control of the switching between the positioning state of the urging member 410 and the positioning-released state of the urging member 410 by the mechanism 500 is automatically performed by a set program. The circuit portion 200 controls the mechanism 500 so that the urging member 410 is kept in the positioning-released state during a normal operation (during non-image formation with a stopped printer) and controls the mechanism 500 so that the urging member 400 is kept in the positioning state during the image formation (during printing with an operated printer). As described above in this embodiment, by employing the means for releasing the urging force to be applied to the cartridge DV by the urging member 410, the urging force can be released in advance when the tray 35 is inserted into the apparatus main assembly 100A. As a result, an operating force required for the user to insert the tray 35 into the apparatus main assembly 100A can be reduced, so that good usability can be obtained. Further, it is possible to prevent image defect due to creep deformation caused in the case where the developing roller 4*a* is urged against the drum 1 for a long time with the same phase. When the urging force applied to the cartridge DV by the urging member 410 is released by the above-described mechanism 500, the developing roller 4*a* and the drum 1 are separated from each other. That is, an elastic force imparting member for imparting an elastic force toward a direction in which the drum 1 of the cartridge DR and the developing roller 4*a* of the cartridge DV are separated from each other when the tray 35 is located at the image forming portion PS. FIG. 21(*b*) is an enlarged view of the driving side of the cartridge DVC. A separating (spacing) lever 450 rotatably mounted to the frame 401 of the cartridge DVC and a coil spring 451 for imparting a force (elastic force) through the separating lever 450 toward a direction in which the cartridge DVC is separated from the cartridge DRC are provided. The separating lever 450 and the coil spring 451 constitute the elastic force imparting member. FIGS. 22(*a*) and 22(*b*) show a state in which the urging force is applied to the cartridge DVC by the urging member 410 and a state in which the urging force is removed (released), respectively. FIG. 22(*a*) is a sectional view showing a state in which the developing roller 4*a* contacts the drum 1 by the urging by the urging member 410 in the urged state of FIG. 21(*a*). FIG. 22(*b*) is a sectional view showing a state in which the developing roller 4*a* is separated from the drum 1 by the release of the urging against the cartridge DVC in the urge-released (separated) state. When the above-described separating operation is performed, the lower surface portions of the shaft supporting portions of the cartridge DVC rub with the positioning portions 41C provided to the left and right stay members 80L and 81R of the apparatus main assembly 100A. In order to prevent an unstable operation by abrasion of the lower surface portions due to the rubbing with the positioning portions 41C, in this embodiment, the stay members 80L and 80R are provided with shaft supporting members 452L and 452R. The cartridge DVY, DVM and DVK other than the cartridge DVC are similarly configured. In a state in which the tray 35 to which the cartridge DV and the cartridge DR are mounted is accommodated in the apparatus main assembly 100A, when the cartridge DV is not urged by the urging member 410, the developing roller 4*a* and the drum 1 are separated from each other. Further, in the urged state, the developing roller 4*a* is urged against the drum 1 with a proper urging force. That is, the developing roller 4*a* can be caused to contact and can be urged against the drum 1 only with a developing timing, and with other timings, the developing roller 4*a* can be separated from the drum 1. As a result, the abrasion between the developing roller 4*a* and the drum 1 can be minimized, so that the lifetimes of the cartridges DV and DR can be prolonged.

Incidentally, the above-described embodiments, compared with the cartridge DR, the cartridge DV has a higher exchange frequency. This is because the lifetime of the cartridge DR is longer than that of the cartridge DV. Specifically, that is because the lifetime of the electrophotographic photosensitive member (the drum) of the cartridge DR is set at a level higher than a corresponding level of an amount of the toner accommodated per one cartridge DV. The reason why such setting is made is that when the amount of the toner accommodated in the cartridge DV is increased, a volume required for accommodating the toner (a volume of the developer accommodating portion) is required to be increased. Therefore, the cartridge DV is increased in size, so that the image forming apparatus is also increased in size. On the other hand, the electrophotographic photosensitive member (the drum) itself cannot be increased in lifetime and even when the lifetime can be prolonged, it does not require an additional space. In this embodiment, the cartridge DV which has the higher exchange frequency than the cartridge DR is demounted from the tray 35 earlier than the cartridge DR. As a result, the usability of exchanging the cartridge DV by the user is improved. Incidentally, when the cartridge DV is mounted to the tray 35, the cartridge DR is mounted to the tray 35 in advance.

[Other Embodiment]

(1) In the above-described embodiments, the tray 35 which is moved linearly in the horizontal direction with respect to a mounting surface D of the apparatus main assembly 100A is described. However, the tray 35 is not limited thereto but may also be configured to be linearly moved in a slanting upward direction or a slanting downward direction with respect to the mounting surface D of the apparatus main assembly 100A.

(2) In the above-described embodiments, the tray 35 linearly moves in a direction perpendicular to the longitudinal direction of the cartridge DR and the cartridge DV which are supported by (accommodated in or mounted to) the tray 35. The longitudinal direction of the cartridge DR and the cartridge DV coincides with those of the drum 1 and the developing roller 4*a*. However, the tray 35 may also be movable linearly in a direction parallel to the longitudinal direction of the cartridge DR and the cartridge DV with respect to the apparatus main assembly 100A.

(3) The tray 35 may also be demountable from the holding members 34L and 34R, i.e., from the apparatus main assembly 100A by releasing the stopper S2.

(4) Further, in the above-described embodiments, the cartridge mounting and demounting position is a position in which the cartridge DR and the cartridge DV are mounted to and demounted from the tray 35. The cartridge mounting and demounting position is located downstream of the image forming position, in which the cartridge DR and the cartridge DV are locatable, with respect to the pull-out direction of the tray 35. The cartridge mounting and demounting position is a position in which the cartridge DR and the cartridge DV which are supported by the tray 35 can be demounted from the tray 35 from the outside of the apparatus main assembly 100A by the user and also a position in which the cartridge DR and the cartridge DV can be supplied by the tray 35 from the outside of the apparatus main assembly 100A by the user. Therefore, the cartridge mounting and demounting position is not limited to the outside of the apparatus main assembly 100A but may also be a position located inside the apparatus main assembly 100A so long as the cartridge DR and the cartridge DV are mountable to and demountable from the tray 35 at the position.

(5) The number of the sets (pairs) of the drum cartridges and the developing cartridge DV is not limited to four but may also be changed to two, three or five or more. Further, in the above-described embodiments, the color electrophotographic image forming apparatus including the plurality of pairs of the cartridge DR and the cartridge DV is described but the present invention is also applicable to a single color (monochromatic) electrophotographic image forming apparatus including a pair of the DR and DV.

(6) The contact and separation between the drum 1 and the belt 13 may also be performed by a method in which the unit 12 is moved relatively to the tray 35 supporting the cartridge DR and the cartridge DV or by a method in which both the unit 12 and the tray 35 are moved relative to each other.

(7) In the above-described embodiments, the unit 12 may also be a recording material (medium) covering transfer belt for holding and conveying the recording material P.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 249959/2008 filed Sep. 29, 2008 and 181780/2009 filed Aug. 4, 2009, which are hereby incorporated by reference.

What is claimed is:

1. An electrophotographic image forming apparatus for forming an image on a recording material in a state in which a drum cartridge including an electrophotographic photosensitive drum is detachably mountable to a main assembly of said electrophotographic image forming apparatus and in a state in which a developing cartridge including a developing roller for developing with a developer an electrostatic latent image formed on the electrophotographic photosensitive drum and including a developer accommodating portion for accommodating the developer is detachably mountable to the main assembly, said electrophotographic image forming apparatus comprising:

a cartridge supporting member movable, in a state of detachably supporting the drum cartridge and the developing cartridge, between an inside position in which said cartridge supporting member is located inside the main assembly and from which the drum cartridge and the developing cartridge are movable to an image forming position in which the drum cartridge and the developing cartridge effect image formation and an outside position in which said cartridge supporting member is located outside the main assembly and in which the drum cartridge and the developing cartridge are mountable and demountable; and a preventing member, provided to the developing cartridge, for preventing demounting of the drum cartridge from said cartridge supporting member in a state in which the developing cartridge is supported by said cartridge supporting member when said cartridge supporting member is located at the outside position.

2. An apparatus according to claim 1, wherein the drum cartridge and the developing cartridge are upwardly demountable from said cartridge supporting member, wherein said preventing member is provided to the developing cartridge so as to be projected above the drum cartridge in a state in which the drum cartridge and the developing cartridge are supported by said cartridge supporting member, and wherein when the drum cartridge is intended to be upwardly demounted from said cartridge supporting member in a state in which the developing cartridge is supported by said cartridge supporting member, said preventing member prevents the demounting of the drum cartridge in contact with the drum cartridge.

3. An apparatus according to claim 1 or 2, wherein said preventing member is provided to the developing cartridge so as to be projected above one end portion and the other end portion of the drum cartridge with respect to a longitudinal direction of the drum cartridge in a state in which the drum cartridge and the developing cartridge and supported by said cartridge supporting member.

4. An apparatus according to claim 1, wherein the drum cartridge and the developing cartridge are upwardly demountable from said cartridge supporting member, wherein said preventing member is provided to the developing cartridge so as to be projected above a grip portion, gripped by a user when the user demounts the drum cartridge from said cartridge supporting member, provided to the drum cartridge in a state in which the drum cartridge and the developing cartridge are supported by said cartridge supporting member; and wherein when the grip position is intended to be gripped by the user in order to upwardly demount the drum cartridge from said cartridge supporting member in a state in which the developing cartridge is supported by said cartridge supporting member, said preventing member prevents the demounting of the drum cartridge in contact with the drum cartridge by preventing the grip position from being gripped by the user.

5. An apparatus according to claim 4, wherein the grip position is provided at an upper surface of the drum cartridge in a state in which the drum cartridge is supported by said cartridge supporting member, and wherein said preventing member is provided to the developing cartridge so as to project above the grip position.

6. An electrophotographic image forming apparatus for forming an image on a recording material in a state in which a drum cartridge including an electrophotographic photosensitive drum is detachably mountable to a main assembly of said electrophotographic image forming apparatus and in a state in which a developing cartridge including a developing roller for developing with a developer an electrostatic latent image formed on the electrophotographic photosensitive drum and including a developer accommodating portion for accommodating the developer is detachably mountable to the main assembly, said electrophotographic image forming apparatus comprising:

a cartridge supporting member movable, in a state of detachably supporting the drum cartridge and the developing cartridge, between an inside position in which said cartridge supporting member is located inside the main assembly and from which the drum cartridge and the developing cartridge are movable to an image forming position in which the drum cartridge and the developing cartridge effect image formation and an outside position in which said cartridge supporting member is located outside the main assembly and in which the drum cartridge and the developing cartridge are mountable and demountable; and a preventing member, provided to the drum cartridge, for preventing demounting of the drum cartridge from said cartridge supporting member in a state in which the developing cartridge is supported by said cartridge supporting member when said cartridge supporting member is located at the outside position.

7. An apparatus according to claim 6, wherein the drum cartridge and the developing cartridge are upwardly demountable from said cartridge supporting member, wherein said cartridge supporting member is provided with an engaging position, wherein said preventing member is provided to an outer surface of a frame for the drum cartridge so as to be projected outward from the outer surface of the frame in a state in which the drum cartridge is supported by said cartridge supporting member, and wherein when the drum cartridge is intended to be upwardly demounted from said cartridge supporting member in a state in which the developing cartridge is supported by said cartridge supporting member, said preventing member prevents the demounting of the drum cartridge in contact with the engaging position.

8. An apparatus according to claim 7, wherein the drum cartridge and the developing cartridge are disposed side by side and are supported by said cartridge supporting member, wherein said preventing member is provided to an outer side surface of the frame, provided along a longitudinal direction of the drum cartridge, so as to be projected outwardly from the outer side surface, wherein the engaging portion is provided above and preventing member, and wherein the drum cartridge is prevented from moving in a direction perpendicular to the longitudinal direction by the developing cartridge.

9. An apparatus according to claim 7, wherein when the developing cartridge is demounted from said cartridge supporting member earlier than the drum cartridge in a state in which the drum cartridge and the developing cartridge are supported by said cartridge supporting member, the drum cartridge is moved toward a space in which the developing cartridge has been supported so that the preventing member does not contact the engaging portion even after the drum cartridge is demounted upwardly from said cartridge supporting member.

10. An apparatus according to claim 1 or 6, wherein said electrophotographic image forming apparatus is a color electrophotographic image forming apparatus capable of forming a color image on the recording material and including four pairs of drum cartridges and developing cartridges, disposed side by side and supported by said cartridge supporting member, consisting of a pair of a drum cartridge and a developing cartridge including a developer accommodating portion accommodating a yellow developer therein, a pair of a drum cartridge and a developing cartridge including a developer accommodating a magenta developer therein, a pair of a drum cartridge and a developing cartridge including a developer accommodating portion accommodating a cyan developer therein, and a pair of a drum cartridge and a developing cartridge including a developer accommodating portion accommodating a black developer therein.

11. An apparatus according to claim 1 or 6, wherein said cartridge supporting member is movable, to the inside position and the outside position, in a direction perpendicular to a longitudinal direction of the drum cartridge and the developing cartridge disposed side by side and supported by said cartridge supporting member.

12. An electrophotographic image forming apparatus for forming an image on a recording material in a state in which a drum cartridge including an electrophotographic photosensitive drum is detachably mountable to a main assembly of said electrophotographic image forming apparatus and in a state in which a developing cartridge including a developing roller for developing with a developer an electrostatic latent image formed on the electrophotographic photosensitive drum and including a developer accommodating portion for accommodating the developer is detachably mountable to the main assembly, said electrophotographic image forming apparatus comprising:

a cartridge supporting member movable, in a state of detachably supporting the drum cartridge and the developing cartridge, between an inside position in which said cartridge supporting member is located inside the main assembly and from which the drum cartridge and the developing cartridge are movable to an image forming position in which the drum cartridge and the developing cartridge effect image formation and an outside position in which said cartridge supporting member is located outside the main assembly and in which the drum cartridge and the developing cartridge are mountable and demountable; and a preventing member, provided to the developing cartridge, for preventing demounting of the drum cartridge from said cartridge supporting member in a state in which the developing cartridge is supported by said cartridge supporting member;

a drum cartridge-side portion to be positioned, provided at the drum cartridge;

a developing cartridge-side portion to be positioned, provided at the developing cartridge;

a drum cartridge-side positioning portion, provided at the main assembly;

a developing cartridge-side positioning portion, provided at the main assembly; and an urging member for urging, in a state in which said cartridge supporting member is located at the inside position, said drum cartridge-side portion to be positioned toward said drum cartridge-side positioning portion and said developing cartridge-side portion to be positioned toward said developing cartridge-side positioning portion, wherein the image is formed on the recording material in a state in which said preventing member is urged by said urging member.

13. An apparatus according to claim 12, further comprising an elastic member, provided between an upper surface of said drum cartridge and a lower surface of said preventing member, for generating a restoring force for separating the developing roller from the electrophotographic photosensitive drum by rotationally moving the developing cartridge in a direction opposite from a direction in which the drum cartridge is provided, wherein the developing roller is separated from the electrophotographic photosensitive drum by the storing force of said elastic member in a state in which urging of said preventing member by said urging member is released.

14. An electrophotographic image forming apparatus for forming an image on a recording material in a state in which a drum cartridge including an electrophotographic photosensitive drum is detachably mountable to a main assembly of said electrophotographic image forming apparatus and in a state in which a developing cartridge including a developing roller for developing with a developer an electrostatic latent image formed on the electrophotographic photosensitive drum and including a developer accommodating portion for accommodating the developer is detachably mountable to the main assembly, said electrophotographic image forming apparatus comprising:

a cartridge supporting member movable, in a state of detachably supporting the drum cartridge and the developing cartridge, between an inside position in which said cartridge supporting member is located inside the main assembly and from which the drum cartridge and the developing cartridge are movable to an image forming position in which the drum cartridge and the developing cartridge effect image formation and an outside position in which said cartridge supporting member is located outside the main assembly and in which the drum cartridge and the developing cartridge are mountable and demountable; and a preventing member, provided to the developing cartridge, for preventing demounting of the drum cartridge from said cartridge supporting member in a state in which the developing cartridge is supported by said cartridge supporting member, wherein the drum cartridge and the developing cartridge are demountable upward from said cartridge supporting member, wherein said cartridge supporting member is provided with an engaging portion, wherein said preventing member is provided so as to be projected outwardly at an outer surface of a frame of said drum cartridge in a state in which the drum cartridge is supported by said cartridge supporting member, and wherein said preventing member prevents demounting of the drum cartridge by contact to the engaging portion when the drum cartridge is intended to be demounted upward from said cartridge supporting member in a state in which the developing cartridge is supported by said cartridge supporting member.

* * * * *